US010942479B1

(12) United States Patent
Sato et al.

(10) Patent No.: US 10,942,479 B1
(45) Date of Patent: Mar. 9, 2021

(54) FIXING DEVICE AND IMAGE FORMING APPARATUS

(71) Applicant: FUJI XEROX CO., LTD., Tokyo (JP)

(72) Inventors: Takaaki Sato, Kanagawa (JP); Kiyoshi Koyanagi, Kanagawa (JP); Toru Inoue, Kanagawa (JP); Sou Morizaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/751,469

(22) Filed: Jan. 24, 2020

(30) Foreign Application Priority Data

Aug. 22, 2019 (JP) ..... JP2019-152303

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2042; G03G 15/2053; G03G 2215/2003
See application file for complete search history.

(56) References Cited

U.S. PATENT DOCUMENTS 9,377,732 B2 6/2016 Hirose et al.
2014/0138372 A1* 5/2014 Ogura ..... G03G 15/2053 219/216
2015/0055993 A1* 2/2015 Shoji ..... G03G 15/2057 399/329
2016/0098001 A1* 4/2016 Ogawa ..... G03G 15/2053 399/338
2016/0139551 A1* 5/2016 Narahara ..... G03G 15/55 399/33
2017/0102651 A1* 4/2017 Tanaka ..... G03G 15/2039

FOREIGN PATENT DOCUMENTS

JP 2003-317898 A 11/2003
JP 2015-219510 A 12/2015
JP 2016-071284 A 5/2016

* cited by examiner

*Primary Examiner* — Thomas S Giampaolo, II
(74) *Attorney, Agent, or Firm* — Sughrue Mion, PLLC

(57) ABSTRACT

A fixing device includes a hollow rotating body, a sheet-shaped heater that is disposed inside the rotating body in such a manner as to extend in a width direction perpendicular to a transport direction of a recording medium, which is transported along with rotation of the rotating body, and that heats the rotating body, and multiple thermal-conductive members that are arranged in such a manner as to be in contact with a surface of the sheet-shaped heater, the surface being opposite to a contact surface of the sheet-shaped heater that is in contact with the rotating body, with a gap formed between the multiple thermal-conductive members in at least one of the width direction and the transport direction and that conduct heat of the sheet-shaped heater in the width direction, the multiple thermal-conductive members being arranged such that a first thermal-conductive member and a second thermal-conductive member that are included in the multiple thermal-conductive members and that are adjacent to each other partially overlap each other when the thermal-conductive members in a state of being arranged in a plane are viewed in the transport direction.

17 Claims, 15 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2019-152303 filed Aug. 22, 2019.

BACKGROUND

(i) Technical Field

The present disclosure relates to a fixing device and an image forming apparatus.

(ii) Related Art

Japanese Unexamined Patent Application Publication No. 2016-71284 discloses an image heating device that includes a heating member including an elongated substrate and resistance heating elements, which are formed on the substrate along the longitudinal direction of the substrate and which generate heat by being energized, an endless belt capable of moving circularly around the heating member while the inner peripheral surface of the endless belt and a first surface of the heating member are in contact with and slide over each other, a thermal-conductive member being in contact with a second surface of the heating member and having a higher thermal conductivity than the substrate, a contact member being in contact with the endless belt, and a rotating body forming a nip part by being in contact with the outer surface of the endless belt and that heats a recording material carrying an image while nipping and transporting the recording material as a result of rotation of the rotating body. In a direction perpendicular to the direction in which the recording material is transported, in a surface of a transport path of the recording material, in a region through which the recording material having a maximum width dimension that the image heating device is capable of transporting passes, a first region in which the thermal-conductive member is in contact with the heating member is larger than a second region in which the thermal-conductive member is not in contact with the heating member, and a third region in which the contact member is in contact with the endless belt in the direction in which the endless belt moves circularly includes at least the second region.

SUMMARY

Aspects of non-limiting embodiments of the present disclosure relate to providing a fixing device and an image forming apparatus having a configuration in which a sheet-shaped heater that heats a plurality of types of recording media having different sizes in a width direction perpendicular to a transport direction while the recording media are being transported is provided and in which a plurality of thermal-conductive members are in contact with a surface of the sheet-shaped heater, the surface being located on the side opposite to the side on which a rotating body is disposed, and capable of suppressing occurrence of variations in the temperature of the sheet-shaped heater in the width direction compared with the configuration in which end surfaces of the adjacent thermal-conductive members extend in the transport direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a hollow rotating body, a sheet-shaped heater that is disposed inside the rotating body in such a manner as to extend in a width direction perpendicular to a transport direction of a recording medium, which is transported along with rotation of the rotating body, and that heats the rotating body, and a plurality of thermal-conductive members that are arranged in such a manner as to be in contact with a surface of the sheet-shaped heater, the surface being opposite to a contact surface of the sheet-shaped heater that is in contact with the rotating body, with a gap formed between the plurality of thermal-conductive members in at least one of the width direction and the transport direction and that conduct heat of the sheet-shaped heater in the width direction, the plurality of thermal-conductive members being arranged such that a first thermal-conductive member and a second thermal-conductive member that are included in the plurality of thermal-conductive members and that are adjacent to each other partially overlap each other when the thermal-conductive members in a state of being arranged in a plane are viewed in the transport direction.

BRIEF DESCRIPTION OF THE DRAWINGS

Exemplary embodiments of the present disclosure will be described in detail based on the following figures, wherein.

DETAILED DESCRIPTION

First Exemplary Embodiment

An image forming apparatus 10 and a fixing device 30 according to a first exemplary embodiment of the present disclosure will be described as an example of an image forming apparatus and an example of a fixing device.

[Overall Configuration]

Figure 1:
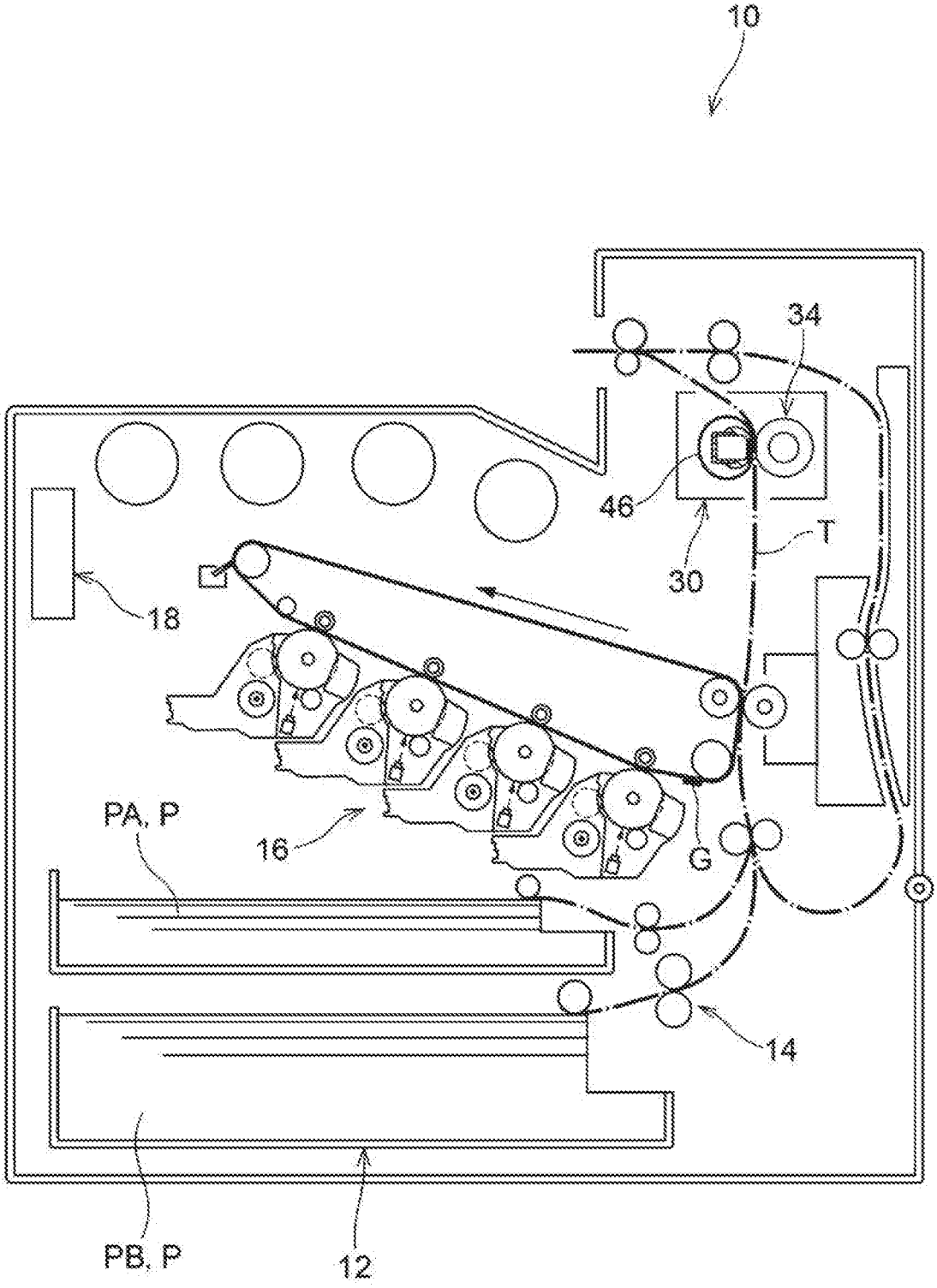
FIG. 1 is a front view of an image forming apparatus according to a first exemplary embodiment.

FIG. 1 illustrates the image forming apparatus 10. The image forming apparatus 10 includes an accommodating unit 12 that accommodates sheets P, a transport unit 14 that transports the sheets P, an image forming unit 16 that forms a toner image G onto one of the sheets P, a controller 18 that controls the operation of each unit of the image forming apparatus 10, and the fixing device 30. In the following direction, a height direction, a depth direction, and a transverse direction of the image forming apparatus 10 will hereinafter be referred to as an "apparatus height direction", an "apparatus depth direction", and an "apparatus width direction", respectively. The apparatus height direction, the apparatus depth direction, and the apparatus width direction are directions that are perpendicular to one another.

Each of the sheets P is an example of a recording medium. As examples of the sheets P, two types of sheets PA and PB whose lengths (widths) in the apparatus width direction are different from each other are used in the first exemplary embodiment. In the following description, a sheet having a small width will be referred to as the sheet PA, and a sheet having a width larger than that of the sheet PA will be referred to as the sheet PB so as to distinguish the sheets P from each other. Note that the sheet PA has a length L1 (mm) in the apparatus width direction, and the sheet PB has a length L2 (mm) in the apparatus width direction (see FIG. 5). The toner image G is an example of a developer image.

The accommodating unit 12 accommodates the sheets PA and PB. The transport unit 14 transports the sheets P from the accommodating unit 12 upward in the apparatus height direction along a transport path T. The image forming unit 16 is an example of an image forming unit. In addition, as an example, the image forming unit 16 performs charging, light exposure, development, and transfer processes that are included in a commonly known electrophotographic system by using a monochromatic color toner or a plurality of colors of toners so as to form the toner image G onto one of the sheets P.

[Configuration of Principal Portion]

The fixing device 30 will now be described.

Figure 2:
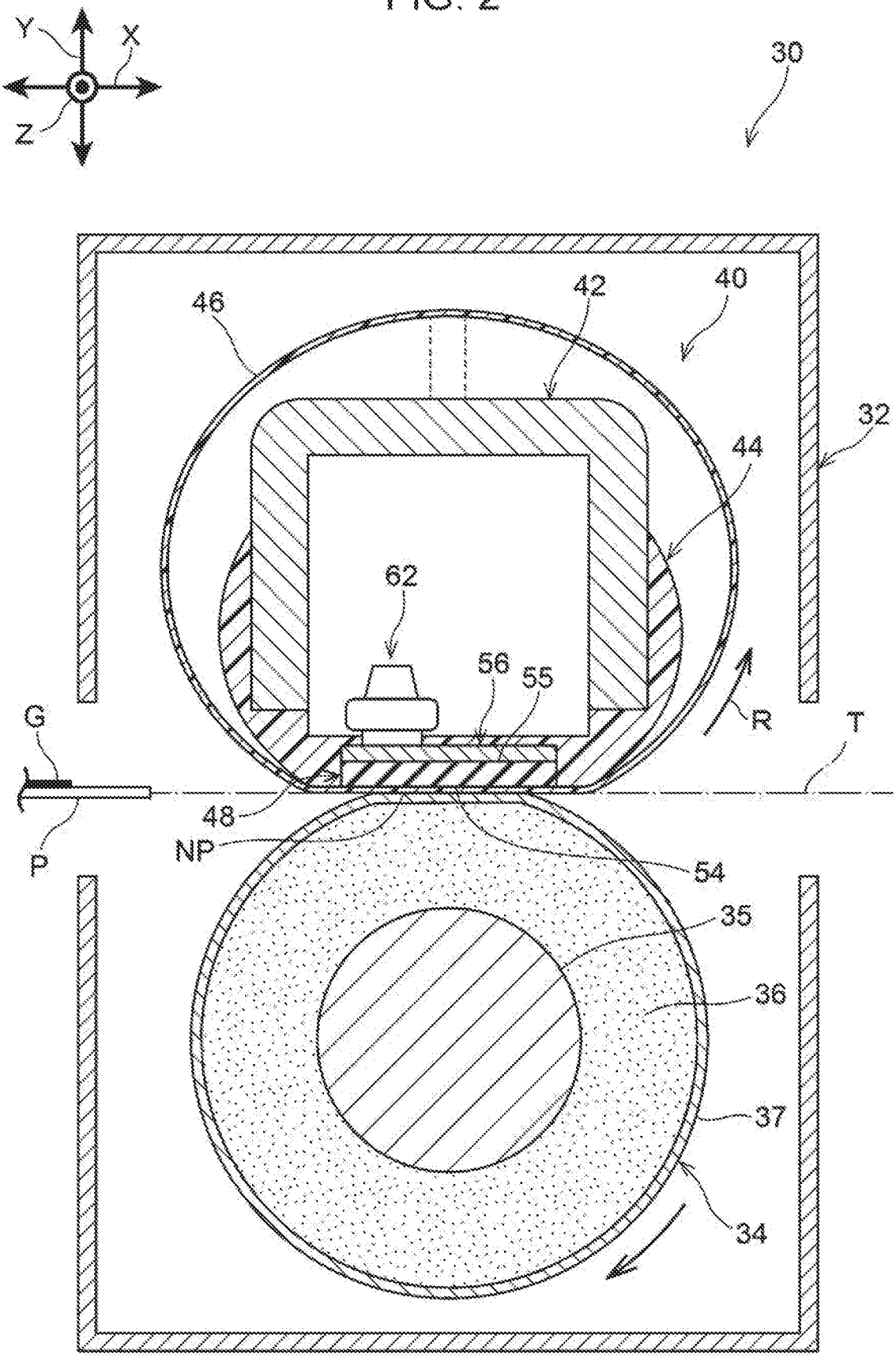
FIG. 2 is a longitudinal sectional view of a fixing device according to the first exemplary embodiment.

The fixing device 30 illustrated in FIG. 2 includes a housing 32 that serves as a device body, a heating unit 40 that is disposed in the housing 32 so as to be located on one side of the transport path T, along which the sheets P are to be transported, and a pressure roller 34 that is disposed in the housing 32 so as to be located on the other side of the transport path T. As an example, a direction in which the transport path T extends (a transport direction of the sheets P) is parallel to the apparatus height direction. In addition, the fixing device 30 employs a center registration system in which each of the sheets P is transported by aligning the center of the transport path T and the center of each of the sheets P in the apparatus depth direction. The fixing device 30 fixes the toner image G onto one of the sheets P by applying heat and pressure to the toner image G.

<Pressure Roller>

The pressure roller 34 is an example of a pressing member and includes a shaft member 35 whose axial direction is parallel to the apparatus depth direction, an elastic layer 36, and a release layer 37. The shaft member 35 is supported by a bearing, which is not illustrated, and is made to rotate by a motor, which is not illustrated. In addition, the shaft member 35 is pressed toward the heating unit 40, which is located on the one side of the transport path T, by a pressing member that includes a spring (not illustrated).

<Heating Unit>

As an example, the heating unit 40 includes a support frame 42, a holding member 44, a belt 46, which is an example of a rotating body, a sheet-shaped heater 48, a plurality of thermal-conductive members 56, and a sensing unit 62. Note that a portion where the outer surface of the belt 46 and the outer peripheral surface of the pressure roller 34 are in contact with each other in a state in which any of the sheets P is not passing between the belt 46 and the pressure roller 34 will be referred to as a nip part NP. Each of the sheets P is transported along with rotation of the belt 46.

(Support Frame)

The support frame 42 is a member that is long in the apparatus depth direction. When viewed in the apparatus depth direction, the cross-sectional shape of the support frame 42 is a U-shape that is open toward the pressure roller 34. In addition, in the apparatus depth direction, the two end portions of the support frame 42 are supported by the housing 32, and a center portion of the support frame 42 is positioned in a space enclosed by the belt 46, which will be described later.

In the following description, the longitudinal direction of the support frame 42 will be referred to as a Z-axis direction. The Z-axis direction is an example of a width direction. In addition, the transport direction that is perpendicular to the Z-axis direction and in which the sheets P are transported within the fixing device 30 will be referred to as an X-axis direction. Furthermore, a direction that is perpendicular to the X-axis direction and the Z-axis direction and that is a thickness direction of the sheet-shaped heater 48 (described later) will be referred to as a Y-axis direction. As an example, in the first exemplary embodiment, the Z-axis direction, the X-axis direction, and the Y-axis direction are respectively parallel to the apparatus depth direction, the apparatus height direction, and the apparatus width direction. In other words, the X-axis direction, the Y-axis direction, and the Z-axis direction are directions that are perpendicular to one another.

In the case of distinguishing positive and negative direction components of the X-axis direction, they will be referred to as an upper side and a lower side. In the case of distinguishing positive and negative direction components of the Y-axis direction, they will be referred to as a heating side and a pressing side. In the case of distinguishing positive and negative direction components of the Z-axis direction, they will be referred to as a far side and a near side.

(Holding Member)

As an example, the holding member 44 is a member that is long in the Z-axis direction and that is made of a polyimide resin. In addition, the holding member 44 is attached to a portion of the support frame 42, the portion being located on the pressing side, and supports the sheet-shaped heater 48 and the plurality of thermal-conductive members 56, which will be described later, in the X-axis direction.

(Belt)

As an example of a hollow rotating body, the belt 46 is a member made of a polyimide resin and having a surface (outer surface) coated with fluorine and is formed in a cylindrical shape (an endless loop shape) when viewed in the Z-axis direction. The two end portions of the belt 46 in the Z-axis direction are each rotatably supported by a cap member (not illustrated). In addition, the belt 46 rotates in the direction of arrow R in FIG. 2 along with rotation of the pressure roller 34 (is driven by the pressure roller 34 and rotates in the direction of arrow R in FIG. 2) so as to transport the sheets P in the X-axis direction. The belt 46 has a length L3 (mm) in the Z-axis direction (see FIG. 5). The length L3 is longer than the above-mentioned length L2 (see FIG. 5).

(Sheet-Shaped Heater)

Figure 5:
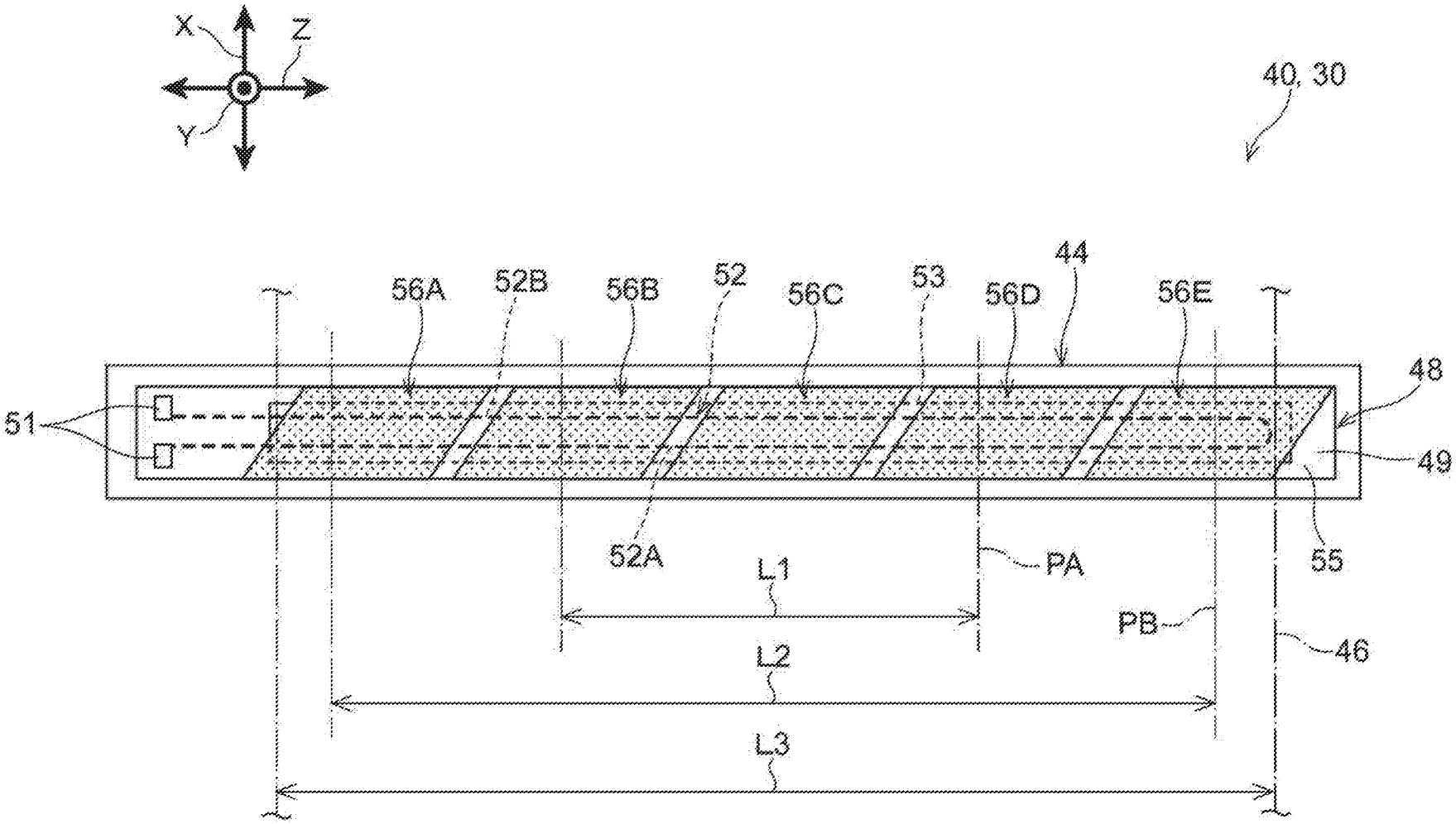
FIG. 5 is a plan view illustrating an arrangement of a resistive element of the sheet-shaped heater according to the first exemplary embodiment, the plurality of thermal-conductive members, and sheets.

The sheet-shaped heater 48 illustrated in FIG. 5 is formed in a rectangular plate-like shape that is long in the Z-axis direction and short in the X-axis direction when viewed in the Y-axis direction. The Z-axis direction is an example of a width direction of the sheet-shaped heater 48. In addition, the sheet-shaped heater 48 includes a base member 49 serving as a body portion, a pair of electrodes 51 for allowing application of a voltage, a resistive element 52, and an insulating film 53.

The base member 49 is formed in a rectangular plate-like shape that is long in the Z-axis direction. The length of the base member 49 in the Z-axis direction is longer than the above-mentioned length L3. The length of the base member 49 in the X-axis direction is shorter than the length of the support frame 42 in the X-axis direction. As an example, the thickness of the base member 49 is 0.7 mm. In addition, as an example, the base member 49 is formed of an alumina compact having an insulating property. In the first exemplary embodiment, the term "insulating property" refers to an electrical conductivity that is equal to or less than $1\times10^{-10}$ S/m. The heat-transfer property of the base member 49 is, for example, isotropic. The thermal conductivity of the base member 49 is, for example, 41 W/mK. Each thermal conductivity described in the first exemplary embodiment conforms to JIS R 2616:2001.

The resistive element 52 is formed in a U-shape that is long in the Z-axis direction when viewed in the Y-axis direction. In addition, the resistive element 52 includes a heat-generating portion 52A that is disposed on the lower side in the X-axis direction (an upstream side in the transport direction) and that extends linearly in the Z-axis direction and a heat-generating portion 52B that is disposed on the upper side in the X-axis direction (a downstream side in the transport direction) and that extends linearly in the Z-axis direction. The heat-generating portion 52A and the heat-generating portion 52B are arranged along the Z-axis direction so as to be approximately parallel to each other with a gap formed therebetween in the X-axis direction. The length of the heat-generating portion 52A in the Z-axis direction and the length of the heat-generating portion 52B in the Z-axis direction are equal to each other and are each longer than the above-mentioned length L2.

In addition, the resistive element 52 is coated with the insulating film 53 made of a heat-resistant resin material. As an example, a surface of the insulating film 53 and a surface of the base member 49 are aligned at approximately the same height. The resistive element 52 is electrically connected to the pair of electrodes 51. Here, a current flows from a power supply (not illustrated) to the resistive element 52 through the pair of electrodes 51 (the resistive element 52 is energized), so that the heat-generating portions 52A and 52B generate heat.

As illustrated in FIG. 2, the sheet-shaped heater 48 is disposed in the space enclosed by the belt 46 such that the thickness direction of the sheet-shaped heater 48 is parallel to the Y-axis direction and is held by the holding member 44. More specifically, the sheet-shaped heater 48 is disposed on the heating side in the Y-axis direction with respect to the belt 46 at the nip part NP and is in contact with the inner surface of the belt 46. A surface of the sheet-shaped heater 48 that is in contact with the belt 46 will be referred to as a contact surface 54. Another surface of the sheet-shaped heater 48, the surface being located on the side opposite to the side on which the belt 46 is disposed in the Y-axis direction, will be referred to as a rear surface 55. The sheet-shaped heater 48 nips the belt 46 and one of the sheets P together with the pressure roller 34 at the nip part NP so as to apply heat and pressure to the belt 46 and the sheet P.

(Thermal-Conductive Member)

As illustrated in FIG. 5, the fixing device 30 includes five thermal-conductive members 56 as an example. Note that FIG. 5 illustrates a state in which the five thermal-conductive members 56 are arranged in an X-Z plane and viewed in the Y-axis direction. Each of the five thermal-conductive members 56 is a member that is in contact with the rear surface 55 and that conducts heat, which is conducted thereto from the sheet-shaped heater 48, in the Z-axis direction. As an example, each of the five thermal-conductive members 56 is made of graphite. The thermal conductivity of each of the thermal-conductive members 56 in the Z-axis direction is higher than the thermal conductivity of the base member 49 in the Z-axis direction. As an example, the thickness of each of the thermal-conductive members 56 is 0.3 mm.

Figure 3A:
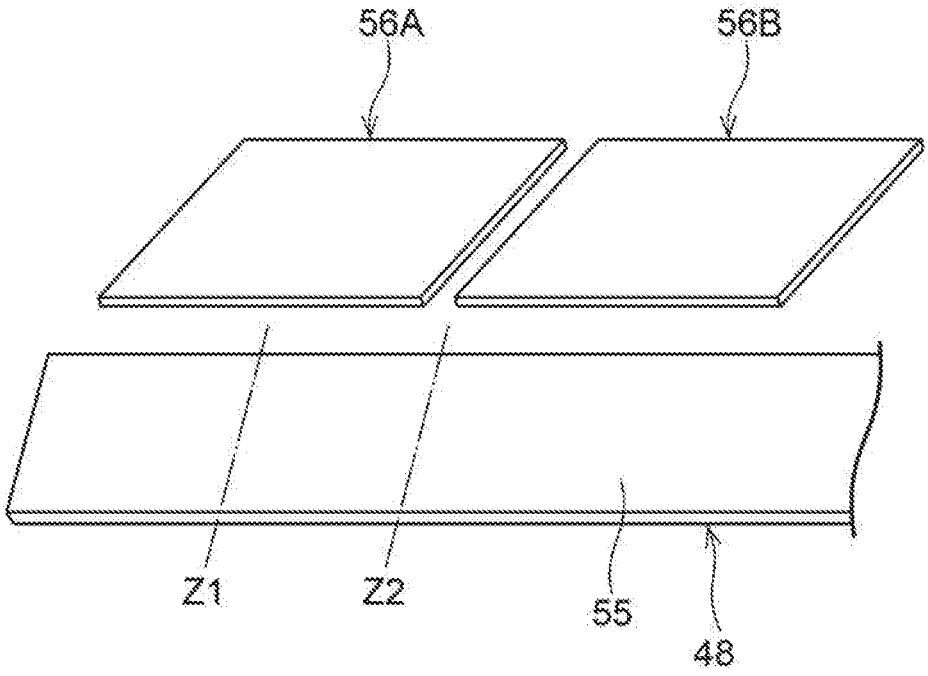
FIG. 3A is a perspective view illustrating a portion of a sheet-shaped heater according to the first exemplary embodiment and two of a plurality of thermal-conductive members according to the first exemplary embodiment.

As illustrated in FIG. 3A, each of the thermal-conductive members 56 is formed in a flat plate-like shape whose thickness direction is parallel to the Y-axis direction. In addition, the external shape of each of the thermal-conductive members 56 when viewed in the Y-axis direction is a parallelogram shape as an example. Each of the thermal-conductive members 56 is placed on the rear surface 55 of the sheet-shaped heater 48.

The thermal conductivity of each of the thermal-conductive members 56, which are illustrated in FIG. 5, in an in-plane direction is 1,000 W/mK as an example. The thermal conductivity of each of the thermal-conductive members 56 in the thickness direction is 15 W/mK as an example. In other words, in the thermal-conductive members 56, heat is conducted more in the Z-axis direction than in the Y-axis direction.

As an example, the five thermal-conductive members 56 are formed by dividing a single thermal-conductive member (not illustrated) that is long in the Z-axis direction into five portions in the Z-axis direction such that the five portions have the same size and the same shape. If a single elongated thermal-conductive member and a single elongated sheet-shaped heater 48 are brought into contact with each other, deformation will occur in the thermal-conductive member due to the difference in thermal expansion coefficient between the thermal-conductive member and the sheet-shaped heater 48, and in order to suppress such deformation, a single thermal-conductive member is divided into five portions (a plurality of thermal-conductive members are arranged).

Note that, in the case of distinguishing the five thermal-conductive members 56, the letters A, B, C, D, and E are added to the reference numeral 56 such that the thermal-conductive members 56A, 56B, 56C, 56D, and 56E are arranged in this order starting from the near side in the Z-axis direction. The thermal-conductive member 56C is disposed so as to be in contact with a center portion of the sheet-shaped heater 48 in the Z-axis direction. In addition, the thermal-conductive member 56C is disposed in an area through which all the sheets P pass.

The thermal-conductive member 56B is positioned such that the position of an end of the sheet PA on the near side in the Z-axis direction substantially corresponds to the center of the thermal-conductive member 56B in the Z-axis direction. The thermal-conductive member 56D is positioned such that the position of an end of the sheet PA on the far side in the Z-axis direction substantially corresponds to the center of the thermal-conductive member 56D in the Z-axis direction. An end of the sheet PB on the near side in the Z-axis direction is positioned on the near side with respect to the center of the thermal-conductive member 56A in the Z-axis direction is. An end of the sheet PB on the far side in the Z-axis direction is positioned on the far side with respect to the center of the thermal-conductive member 56E in the Z-axis direction.

The configurations of the thermal-conductive members 56A, 56B, 56C, 56D, and 56E are similar to one another. Thus, the thermal-conductive members 56A and 56B will now be described, and descriptions of the thermal-conductive members 56C, 56D, and 56E will be omitted.

Figure 4A:
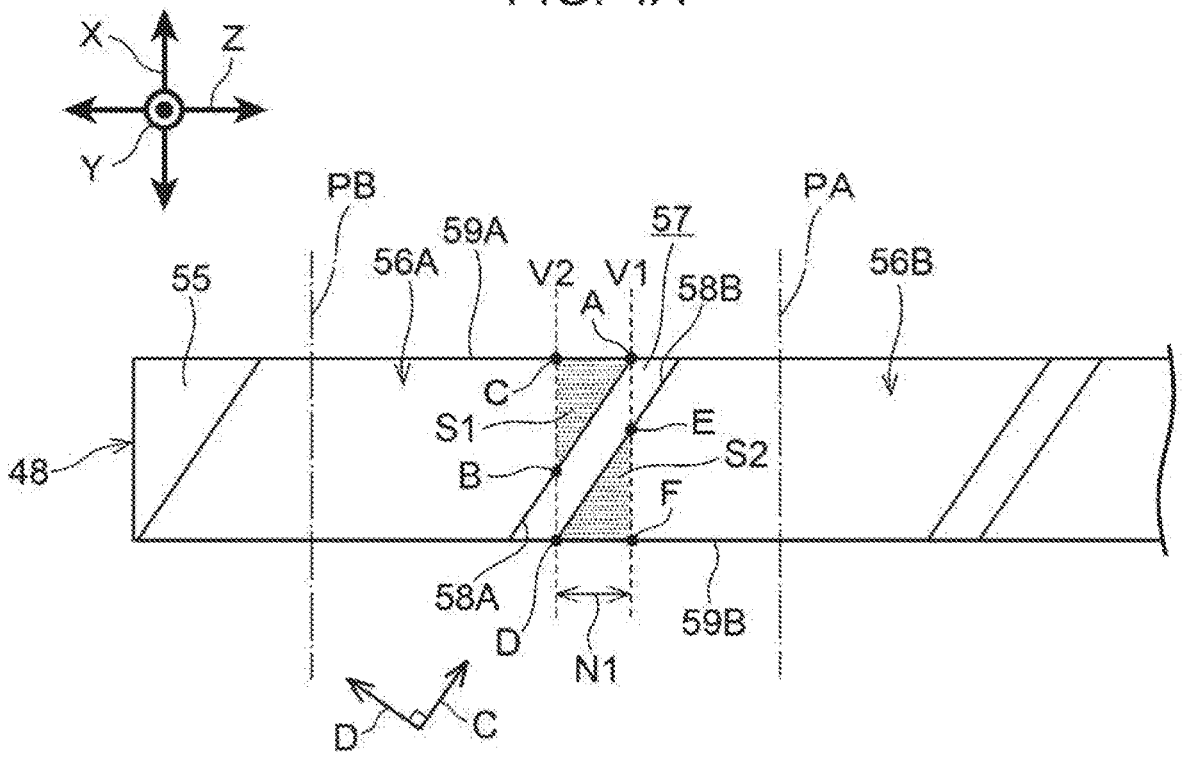
FIG. 4A is a plan view illustrating an arrangement of the two thermal-conductive members according to the first exemplary embodiment.

FIG. 4A illustrates a state in which the thermal-conductive member 56A and the thermal-conductive member 56B are arranged in the X-Z plane and viewed in the Y-axis direction. The thermal-conductive member 56A and the thermal-conductive member 56B are arranged so as to be adjacent to each other in the Z-axis direction with a gap (a space 57) formed therebetween in the Z-axis direction. When viewed in the X-axis direction, an end portion of the thermal-conductive member 56A, the end portion being located on the far side in the Z-axis direction, and an end portion of the thermal-conductive member 56B, the end portion being located on the near side in the Z-axis direction, are positioned so as to overlap each other in the X-axis direction. As an example, in the Z-axis direction, these overlapping portions are located further toward the near side than the end of the sheet PA on the near side is and are located further toward the far side than the end of the sheet PB on the near side is. In addition, the thermal-conductive member 56A and the thermal-conductive member 56B have the same length in the X-axis direction, and when viewed in the Z-axis direction, the thermal-conductive member 56A and the thermal-conductive member 56B entirely overlap each other (overlap each other from one end to the other end thereof) in the X-axis direction.

When viewed in the Y-axis direction, the space 57 extends linearly in a crossing direction (hereinafter referred to as a C direction) that crosses the X-axis direction. Note that a direction that is perpendicular to the C direction when viewed in the Y-axis direction will be referred to as a D direction. Here, a side surface of the thermal-conductive member 56A and a side surface of the thermal-conductive member 56B, the side surfaces defining the space 57, will be referred to as a facing surface 58A and a facing surface 58B, respectively. The facing surface 58A and the facing surface 58B are examples of facing edges that face each other. As described above, the facing surface 58A and the facing surface 58B extend in the C direction when viewed in the Y-axis direction and face each other with the space 57 formed therebetween in the D direction.

The position of an end of the facing surface 58A, the end being located on the far side in the Z-axis direction when the thermal-conductive members 56A and 56B are viewed in the Y-axis direction, (an acute-angle vertex of a parallelogram) is denoted by a point A. The point A is positioned on an upper surface 59A of the thermal-conductive member 56A that is located on the upper side in the X-axis direction. A line that passes through the point A and extends in the X-axis direction will be referred to as an imaginary line V1. A surface of the thermal-conductive member 56B that is located on the lower side in the X-axis direction will be referred to as a lower surface 59B. A point of intersection of the imaginary line V1 and the facing surface 58B is denoted by a point E, and a point of intersection of the imaginary line V1 and the lower surface 59B is denoted by a point F. Similarly, a position corresponding to an end of the facing surface 58B, the end being located on the near side in the Z-axis direction (an acute-angle vertex of a parallelogram) is denoted by a point D. The point D is positioned on the lower surface 59B. A line that passes through the point D and extends in the X-axis direction will be referred to as an imaginary line V2. A point of intersection of the imaginary line V2 and the facing surface 58A is denoted by a point B, and a point of intersection of the imaginary line V2 and the lower surface 59A is denoted by a point C.

Here, portions of the thermal-conductive members 56A and 56B that are positioned in a region between the imaginary line V1 and the imaginary line V2 in the Z-axis direction (hereinafter referred to as a region N1) are the portions that overlap each other when viewed in the X-axis direction. When viewed in the Y-axis direction, these portions are formed of an end portion S1 that is represented by a triangle ABC and an end portion S2 that is represented by a triangle DEF. In the thermal-conductive member 56A, heat is conducted from the end portion S1 to the other portions. In the thermal-conductive member 56B, heat is conducted from the end portion S2 to the other portions. Note that the region N1 is located between the end of the sheet PA on the near side in the Z-axis direction and the end of the sheet PB on the near side in the Z-axis direction.

As an example, the length of the thermal-conductive member 56A in the X-axis direction, the length of the thermal-conductive member 56B in the X-axis direction, and the length of the sheet-shaped heater 48 in the X-axis direction are set to be equal to one another. In addition, as an example, the two ends of each of the thermal-conductive members 56A and 56B in the X-axis direction are aligned with the respective two ends of the sheet-shaped heater 48 in the X-axis direction when viewed in the Y-axis direction.

Figure 4B:
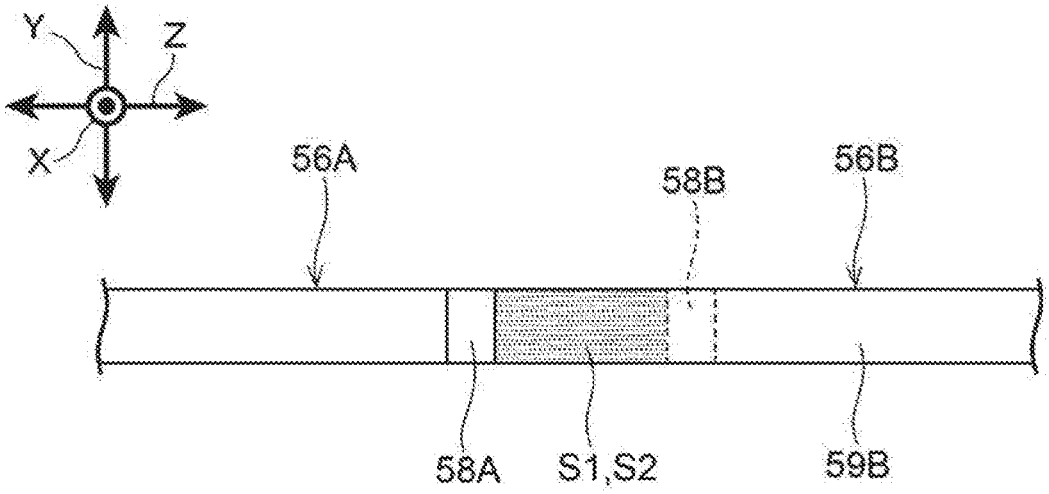
FIG. 4B is a side view illustrating a state where the two thermal-conductive members according to the first exemplary embodiment overlap each other.

FIG. 4B illustrates a state in which the thermal-conductive member 56A and the thermal-conductive member 56B are arranged in the X-Z plane and viewed in the X-axis direction. The end portion S1 of the thermal-conductive member 56A and the end portion S2 of the thermal-conductive member 56B overlap each other in the X-axis direction as indicated half-tone shading. In other words, the end portion S1 and the end portion S2 are arranged so as to overlap each other when they are projected in the X-axis direction.

(Sensing Unit)

Figure 6:
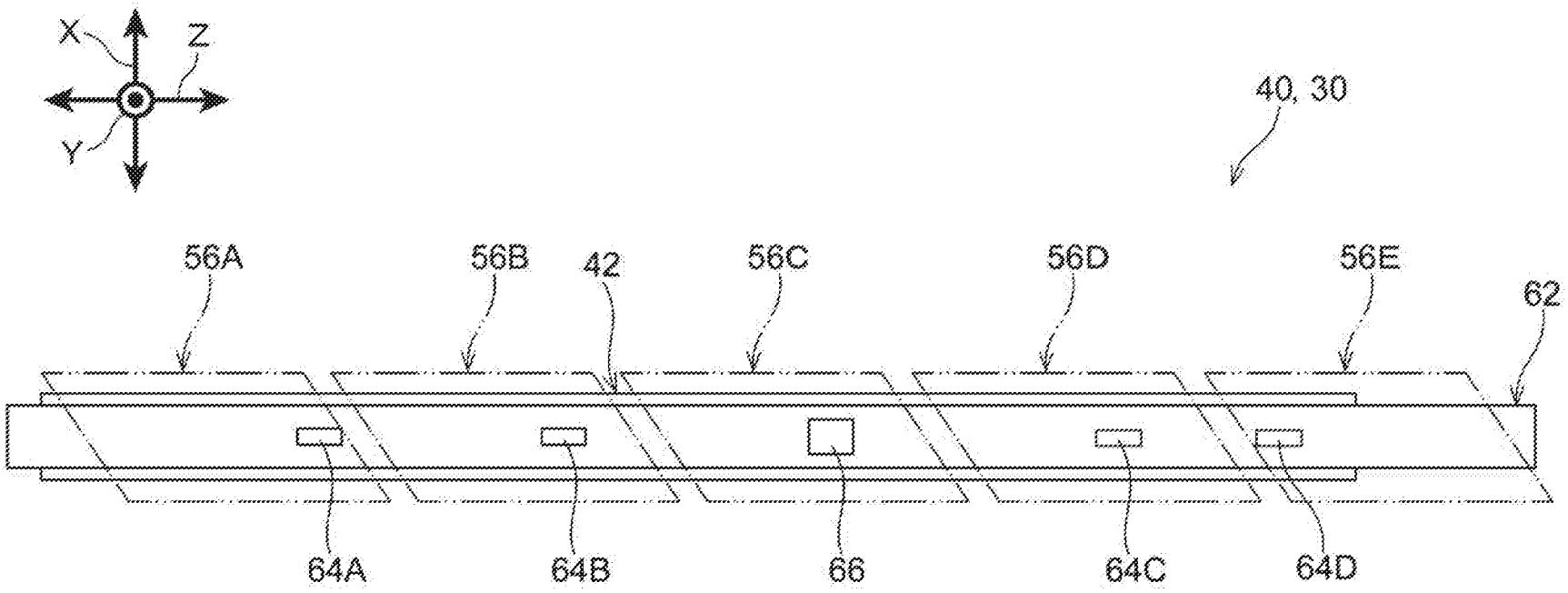
FIG. 6 is a diagram illustrating the positional relationship between the plurality of thermal-conductive members according to the first exemplary embodiment, thermistors, and a thermostat.

FIG. 6 illustrates the thermal-conductive members 56A, 56B, 56C, 56D, and 56E and the sensing unit 62 as seen from the nip part NP (see FIG. 2). As an example, the sensing unit 62 includes four thermistors 64A, 64B, 64C, and 64D and a single thermostat 66. The thermistor 64A detects the temperature of the thermal-conductive member 56A. The thermistor 64B detects the temperature of the thermal-conductive member 56B. The thermistor 64C detects the temperature of the thermal-conductive member 56D. The thermistor 64D detects the temperature of the thermal-conductive member 56E. The thermostat 66 stops energization of the sheet-shaped heater 48 (see FIG. 2) when the temperature of the thermal-conductive member 56C exceeds a set temperature, which is set beforehand, so as to suppress an excessive rise in the temperature of the sheet-shaped heater 48.

Comparative Example

Figure 14A:
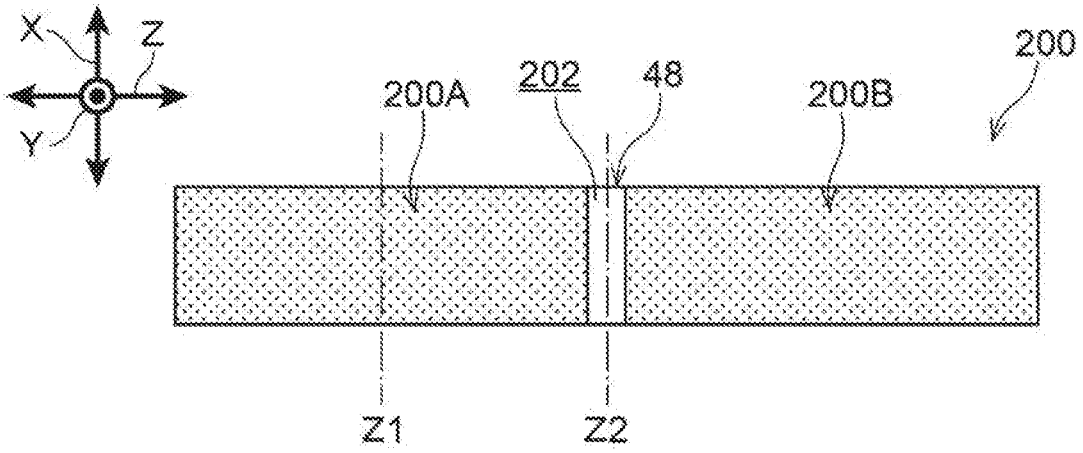
FIG. 14A is a plan view illustrating an arrangement of two thermal-conductive members according to a comparative example.

FIG. 14A illustrates a portion of a fixing device 200 according to a comparative example. The only difference between the fixing device 200 and the fixing device 30 (see FIG. 2) is that the thermal-conductive members 56 (see FIG. 2) in the fixing device 30 are changed to thermal-conductive members 200A and 200B.

The thermal-conductive members 200A and 200B are each formed in a rectangular shape that is long in the Z-axis direction and are arranged with a gap formed therebetween in the Z-axis direction. A space 202 between the thermal-conductive member 200A and the thermal-conductive member 200B extends linearly in the X-axis direction. In other words, when viewed in the X-axis direction, the thermal-conductive member 200A and the thermal-conductive member 200B do not overlap each other in the X-axis direction. In the Z-axis direction, the center position of the thermal-conductive member 200A in the Z-axis direction will be referred to as a position Z1, and the center position of the space 202 in the Z-axis direction will be referred to as a position Z2.

Figure 14B:
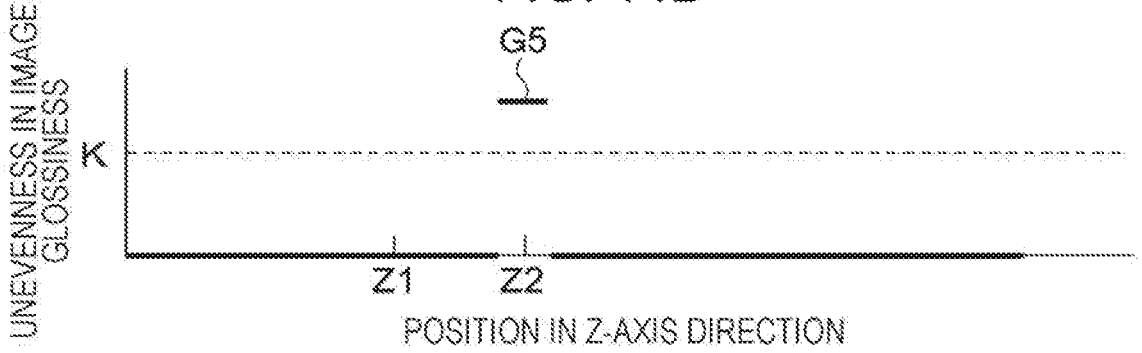
FIG. 14B is a graph illustrating variations of unevenness in image glossiness in a width direction in a fixing device according to the comparative example.

In FIG. 14B, positions in the X-axis direction corresponding to the thermal-conductive member 200A, the space 202, and the thermal-conductive member 200B (see FIG. 14A), unevenness in image glossiness at each position, and a threshold K that indicates an upper limit within an acceptable range of unevenness in image glossiness are illustrated as a graph G5. The image glossiness is a characteristic value measured by using a gloss meter conforming to the definitions described in JIS standard Z8741. Unevenness in the image glossiness is determined by measuring the glossiness of the toner image G having a rectangular shape that is long in the Z-axis direction by using the gloss meter after the toner image G has been fixed in place and calculating a difference value between the maximum value and the minimum value of the glossiness in the X-axis direction at each position in the Z-axis direction.

In the fixing device 200 of the comparative example, the degree of unevenness in the image glossiness is smaller than the threshold K at, for example, the position Z1 and is larger than the threshold K at the position Z2. This is presumably because, although the thermal-conductive member 200A is capable of transferring heat in the Z-axis direction at the position Z1, the thermal-conductive members 200A and 200B are not present at the position Z2, so that the amount of heat transferred from the other portion is insufficient, and the temperature of a portion of the sheet-shaped heater 48 in the X-axis direction becomes lower than the temperatures of the other portions of the sheet-shaped heater 48.

Figure 14C:
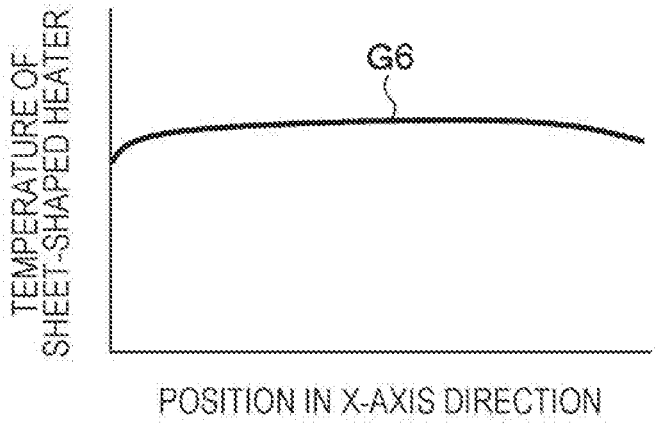
FIG. 14C is a graph illustrating temperature distribution in the transport direction in a portion of a sheet-shaped heater according to the comparative example, the portion being in contact with one of the thermal-conductive members.

FIG. 14C illustrates a graph G6 illustrating the relationship between position in the X-axis direction and the temperature of the sheet-shaped heater 48 at the position Z1 (see FIG. 14A). At the position Z1, the thermal-conductive member 200A (see FIG. 14A) is present and extends in the X-axis direction, and thus, the temperature of the sheet-shaped heater 48 is less likely to vary regardless of the position in the X-axis direction.

Figure 14D:
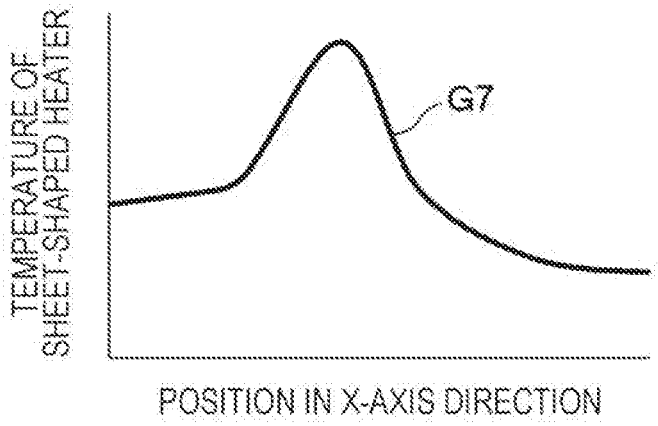
FIG. 14D is a graph illustrating temperature distribution in the transport direction in a gap portion of the sheet-shaped heater according to the comparative example, the gap portion being not in contact with any of the thermal-conductive members.

FIG. 14D illustrates a graph G6 illustrating the relationship between position in the X-axis direction and the temperature of the sheet-shaped heater 48 at the position Z2 (see FIG. 14A). Since the thermal-conductive member 200A is not present at the position Z2, the amount of heat that is supplied to the sheet-shaped heater 48 in the Z-axis direction is small, and the temperature of the sheet-shaped heater 48 becomes lower than the temperature at the position Z1 (in the graph G6, see FIG. 14C). Note that the temperature of the sheet-shaped heater 48 locally increases at a portion of the sheet-shaped heater 48 on which the resistive element 52 (see FIG. 5) is disposed.

<Effects>

Effects of the fixing device 30 and the image forming apparatus 10 according to the first exemplary embodiment will now be described.

Figure 7:
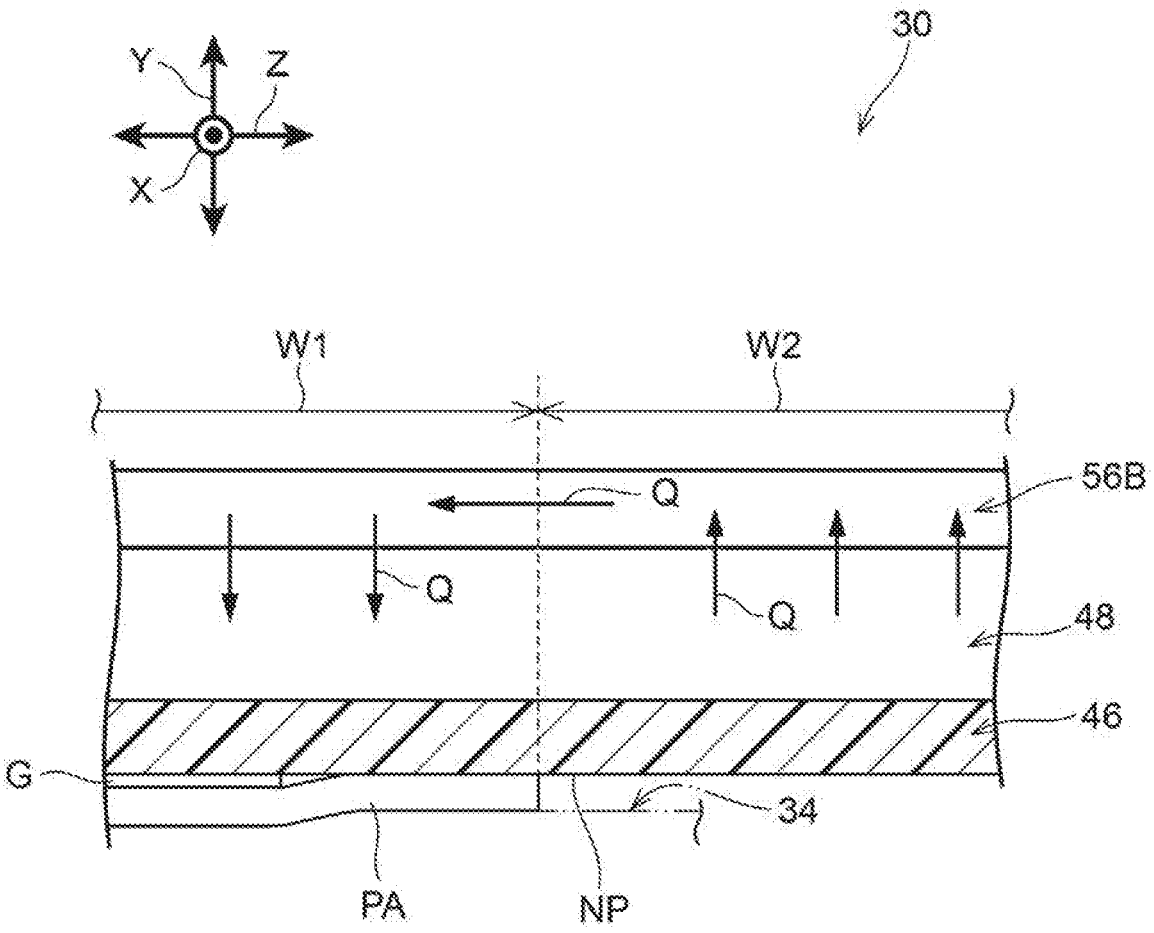
FIG. 7 is a diagram illustrating a state where heat is conducted from the sheet-shaped heater according to the first exemplary embodiment to one of the thermal-conductive members.

In the fixing device 30 illustrated in FIG. 7, the sheet-shaped heater 48 generates heat by being energized, and as a result, the belt 46 is heated. Then, the sheet PA on which the toner image G has been formed enters between the belt 46 and the pressure roller 34 (the nip part NP), so that the toner image G is heated and pressurized, and the toner image G is fixed onto the sheet PA. The sheet PA to which the toner image G has been fixed is ejected from the nip part NP along with rotations of the pressure roller 34 and the belt 46.

Heat Q is supplied to the sheet PA and the toner image G at a portion of the sheet-shaped heater 48 in the Z-axis direction, the portion being located, when viewed in the X-axis direction, in a sheet-passing region W1 through which the sheet PA passes, so that the temperature of this portion becomes lower than the temperature immediately before the toner image G is fixed onto the sheet PA. In order to eliminate this local decrease in the temperature of the sheet-shaped heater 48, energization of the sheet heating element 48 is performed, so that the amount of heat generated by the entire sheet-shaped heater 48 increases.

In contrast, in a non-sheet-passing region W2 that corresponds to a portion of the sheet-shaped heater 48 in the Z-axis direction and that is located outside the sheet-passing region W1, through which the sheet PA passes, in the Z-axis direction when viewed in the X-axis direction, the sheet PA and the toner image G are not present, and the heat Q is less likely to be consumed. Thus, the temperature of the sheet-shaped heater 48 becomes higher than the temperature of the sheet-shaped heater 48 in the sheet-passing region W1. In the non-sheet-passing region W2, the temperature of the thermal-conductive member 56B is lower than the temperature of the sheet-shaped heater 48, and thus, the heat Q is transferred from the sheet-shaped heater 48 to the thermal-conductive member 56B.

The heat Q transferred to the thermal-conductive member 56B is conducted to the sheet-passing region W1 by a property of the thermal-conductive member 56B (a property of conducting more heat in the Z-axis direction than in the Y-axis direction). Then, the heat Q is transferred from the thermal-conductive member 56B to the sheet-shaped heater 48 in the sheet-passing region W1. In this manner, the excessive heat Q in the non-sheet-passing region W2 of the sheet-shaped heater 48 is transferred to the sheet-passing region W1 of the sheet-shaped heater 48, so that the temperature in the non-sheet-passing region W2 decreases, and the temperature in the sheet-passing region W1 increases. In other words, variations in the temperature of the sheet-shaped heater 48 in the Z-axis direction are reduced.

In addition, as illustrated in FIG. 4A, the end portion S1 of the thermal-conductive member 56A and the end portion S2 of the thermal-conductive member 56B are arranged so as to overlap each other when viewed in the X-axis direction, so that the thermal-conductive members 56 are always present on (in contact with) a portion of the sheet-shaped heater 48 in the X-axis direction. Accordingly, in the X-axis direction, there is no region where the thermal-conductive members 56 are not present, and thus, excessive heat in the non-sheet-passing region W2 (see FIG. 7) of the sheet-shaped heater 48, through which the sheet PA does not pass, is more easily conducted and transferred in the Z-axis direction compared with the above-described comparative example. As a result, occurrence of variations in the temperature of the sheet-shaped heater 48 in the Z-axis direction is suppressed.

As a result of reducing variations in the temperature of the sheet-shaped heater 48 in the Z-axis direction, when the sheet PB passes through the nip part NP (see FIG. 2) after the toner image G has been fixed to the sheet PA, occurrence of variations in the temperature of the sheet PB in the Z-axis direction is suppressed. In addition, as a result of suppressing occurrence of variations in the temperature of the sheet-shaped heater 48 in the Z-axis direction, occurrence of variations in the pressure inside the sheet-shaped heater 48 or inside the thermal-conductive members 56 in the Z-axis direction due to thermal expansion is suppressed.

In the fixing device 30, the adjacent thermal-conductive members 56A and 56B have the same length in the X-axis direction and entirely overlap each other when viewed in the Z-axis direction. As a result, the area of a portion of the sheet-shaped heater 48 that is not in contact with the thermal-conductive members 56 is smaller than that in the configuration in which only portions of the thermal-conductive members 56A and 56B face each other in the Z-axis direction. In other words, the area of a portion the sheet-shaped heater 48 to which heat is conducted by the thermal-conductive members 56 increases, and thus, variations in the temperature of each of the sheets P in the Z-axis direction is reduced compared with the configuration in which only portions of the thermal-conductive members 56A and 56B face each other in the Z-axis direction.

In addition, in the fixing device 30, the facing surfaces 58A and 58B extend in the C direction.

Consequently, it is easier to cut and form the facing surfaces 58A and 58B compared with the configuration in which each of the facing surfaces 58A and 58B is formed in a step-like shape, and this facilitates manufacture of the thermal-conductive members 56.

According to the image forming apparatus 10 (see FIG. 1), by providing the fixing device 30, occurrence of variations in the temperature of the sheet-shaped heater 48 in the Z-axis direction is suppressed compared with the configuration in which the space 57 extends in the X-axis direction. As a result, when the sheet PB having a width larger than that of the sheet PA passes through the nip part NP (see FIG. 2) in the next fixing operation, occurrence of variations in the temperature of the sheet PB in the Z-axis direction is suppressed, and thus, the probability of occurrence of an image defect due to variations in the temperature of the sheet-shaped heater 48 in the Z-axis direction is reduced. An example of an image defect is a phenomenon in which an image (the toner image G) is partially missed or becomes contaminated when hot offset occurs.

Figure 8A:
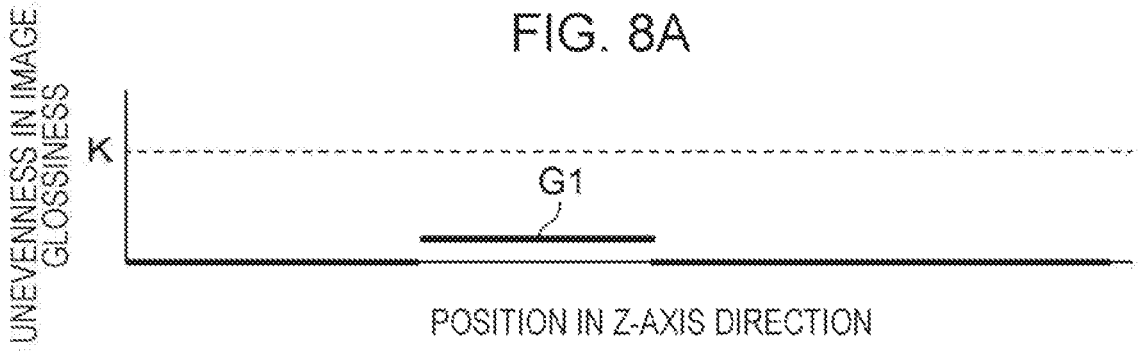
FIG. 8A is a graph illustrating variations of unevenness in image glossiness in a width direction in the fixing device according to the first exemplary embodiment.

In FIG. 8A, positions in the Z-axis direction corresponding to the thermal-conductive member 56A, the space 57, and the thermal-conductive member 56B (see FIG. 4A), unevenness in the image glossiness at each position, and the threshold K are illustrated as a graph G1. In the fixing device 30 according to the first exemplary embodiment (see FIG. 2), the degree of unevenness in the image glossiness is smaller than the threshold K at the position Z1 and the position Z2 (see FIG. 3A). This is presumably because, at the position Z2, heat is conducted in the Z-axis direction, and a temperature decrease is suppressed compared with the above-described comparative example.

Figure 8B:
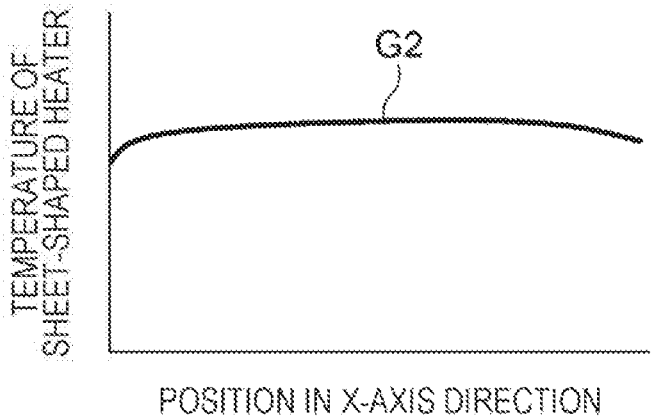
FIG. 8B is a graph illustrating temperature distribution in a transport direction in a portion of the sheet-shaped heater according to the first exemplary embodiment, the portion being in contact with a center portion of one of the thermal-conductive members.

FIG. 8B illustrates a graph G2 illustrating the relationship between position in the X-axis direction and the temperature of the sheet-shaped heater 48 at the position Z1 (see FIG. 3A). At the position Z1, the thermal-conductive members 56A and 56B (see FIG. 3A) are present and extend in the X-axis direction, and thus, the temperature of the sheet-shaped heater 48 is less likely to vary regardless of the position in the X-axis direction.

Figure 8C:
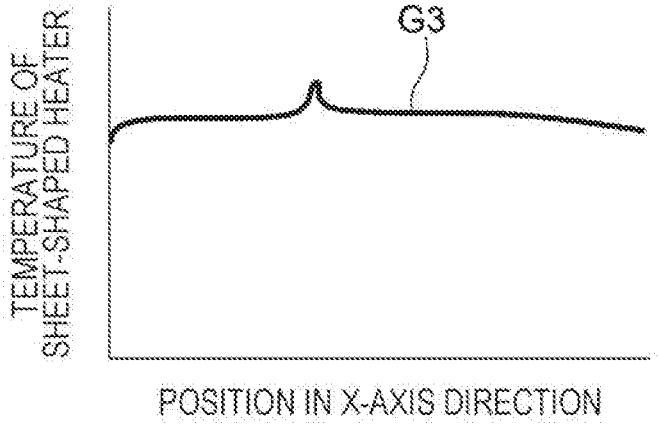
FIG. 8C is a graph illustrating temperature distribution in the transport direction in a portion of the sheet-shaped heater according to the first exemplary embodiment, the portion being in contact with end portions of some of the thermal-conductive members.

FIG. 8C illustrates a graph G3 illustrating the relationship between position in the X-axis direction and the temperature of the sheet-shaped heater 48 at the position Z2 (see FIG. 3A). Portions of the thermal-conductive members 56A and 56B are present at the position Z2, the portions having an area smaller than that of the portions of the thermal-conductive members 56A and 56B that are present at the position Z1, and thus, heat is supplied to the sheet-shaped heater 48 in the Z-axis direction, so that the probability that the temperature of the sheet-shaped heater 48 will become lower than the temperature at the position Z1 is reduced. Note that the temperature locally increases at the portion on which the resistive element 52 (see FIG. 5) is present, and thus, a peak appears at the portion.

<Modification>

Figure 3B:
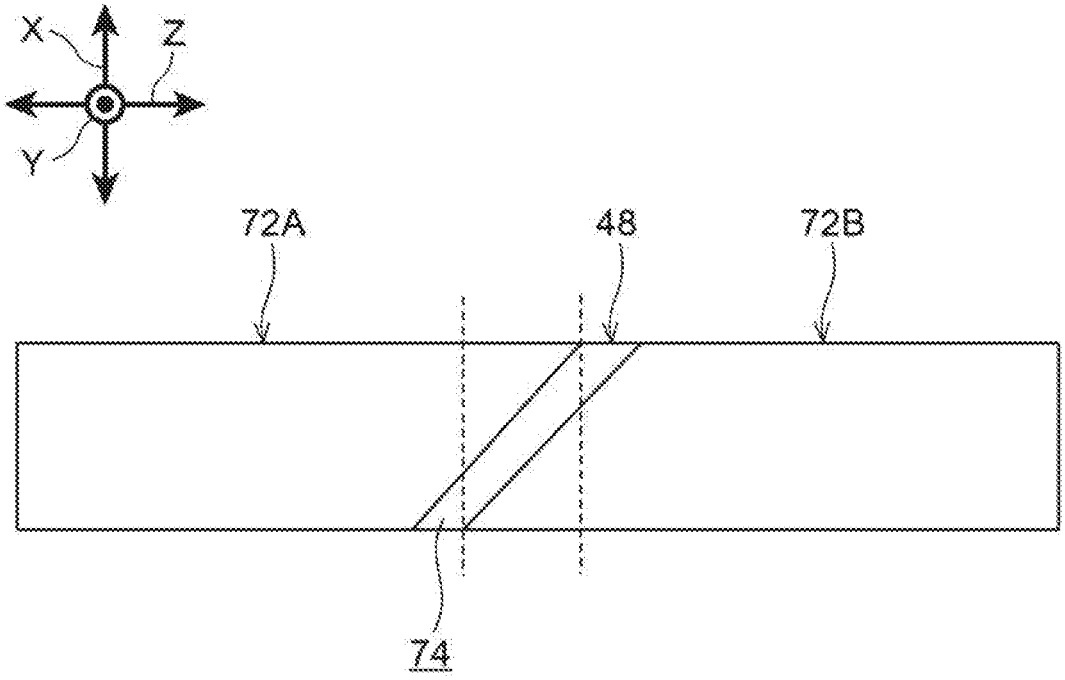
FIG. 3B is a plan view illustrating two thermal-conductive members according to a modification of the first exemplary embodiment when viewed in a thickness direction.

In FIG. 3B, two thermal-conductive members 72 (thermal-conductive members 72A and 72B) are illustrated as a modification of the five thermal-conductive members 56 (see FIG. 2). The thermal-conductive members 72A and 72B are respectively arranged on the near side and the far side with respect to the center the sheet-shaped heater 48 in the Z-axis direction so as to be adjacent to each other. When viewed in the Y-axis direction, the thermal-conductive member 72A is formed in a trapezoidal shape having a lower base located on the upper side in the X-axis direction and an upper base located on the lower side in the X-axis direction. When viewed in the Y-axis direction, the thermal-conductive member 72B is formed in a trapezoidal shape having a lower base located on the lower side in the X-axis direction and an upper base located on the upper side in the X-axis direction.

A portion of the thermal-conductive member 72A and a portion of the thermal-conductive member 72B overlap each other when viewed in the X-axis direction. When viewed in the Y-axis direction, a space 74 between the thermal-conductive member 72A and the thermal-conductive member 72B extends in an oblique direction that crosses the X-axis direction. An end portion of the thermal-conductive member 72A that is located on the near side in the Z-axis direction is in contact with the sheet-shaped heater 48 entirely in the X-axis direction. In this manner, at the two end portions of the sheet-shaped heater 48 in the Z-axis direction, the width of each of the thermal-conductive members in the X-axis direction may be increased more than that of each of the thermal-conductive members 56 according to the first exemplary embodiment.

Second Exemplary Embodiment

An image forming apparatus 10 and a fixing device 80 according to a second exemplary embodiment will now be described. Note that members and portions that are basically the same as those of the image forming apparatus 10 and the fixing device 30 according to the first exemplary embodiment, which have been described above, will be denoted by the same reference signs as used in the first exemplary embodiment, and descriptions thereof will be omitted.

Figure 9:
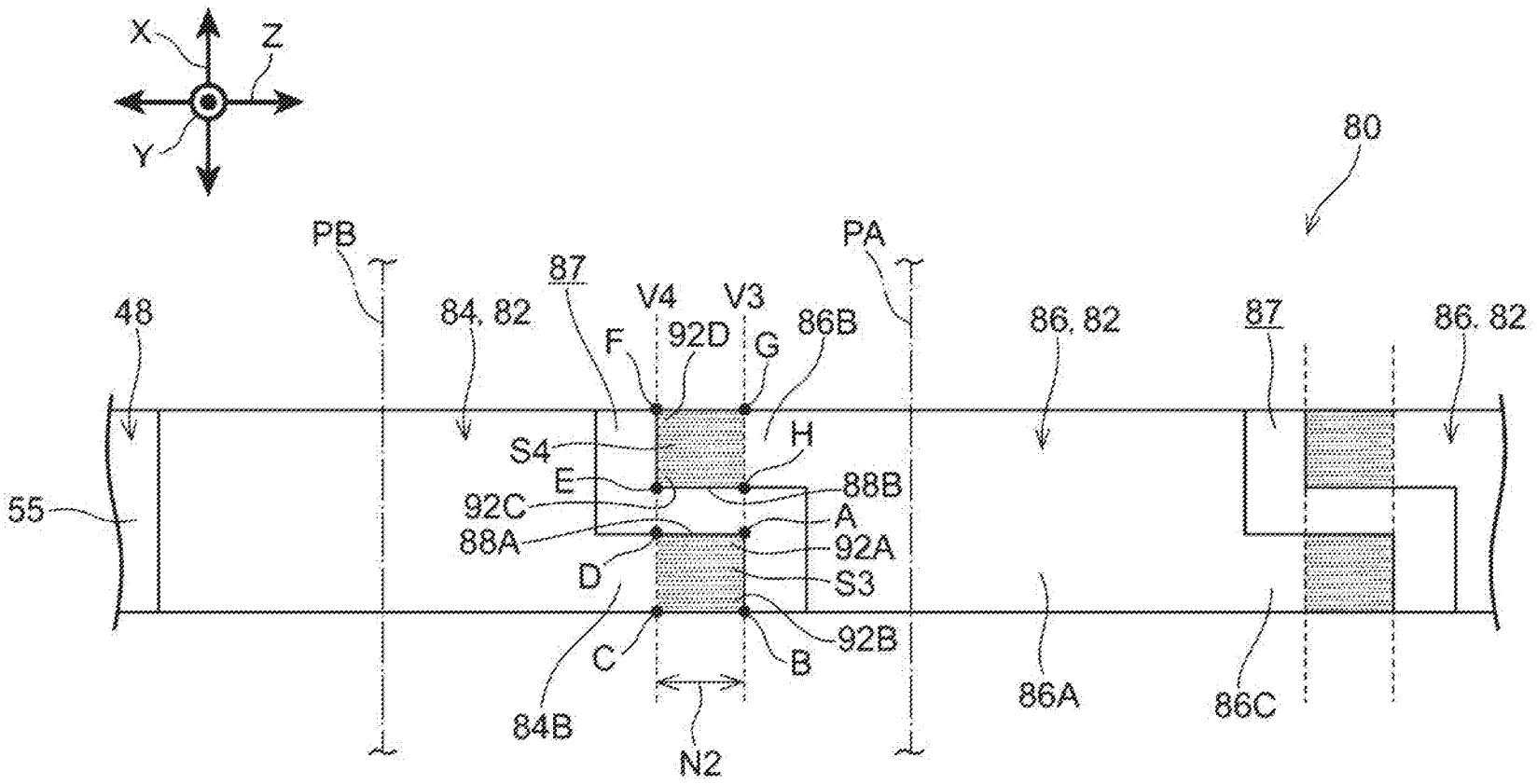
FIG. 9 is a plan view illustrating an arrangement of two thermal-conductive members according to a second exemplary embodiment.

The difference between the fixing device 80 that is illustrated in FIG. 9 and the fixing device 30 (see FIG. 2) is that the fixing device 80 includes a thermal-conductive member 82 instead of the thermal-conductive members 56 (see FIG. 2), and the rest of the configuration of the fixing device 80 is similar to that of the fixing device 30.

As an example, the material of the thermal-conductive member 82 is the same as that of each of the thermal-conductive members 56, and only the external shape of the thermal-conductive member 82 is different from that of each of the thermal-conductive members 56. The thermal-conductive member 82 is in contact with the rear surface 55 and conducts more heat of the sheet-shaped heater 48 in the Z-axis direction than in the Y-axis direction. In addition, as an example, the thermal-conductive member 82 includes two thermal-conductive members 84 (only one of them is illustrated in FIG. 9) and three thermal-conductive members 86 (only two of them are illustrated in FIG. 9). The two thermal-conductive members 84 are positioned at the opposite ends in the Z-axis direction, and the three thermal-conductive members 86 are arranged between the two thermal-conductive members 84 in the Z-axis direction. In other words, the thermal-conductive members 84 and the thermal-conductive members 86 are arranged with gaps (spaces 87) formed therebetween in the Z-axis direction and the X-axis direction. Here, one of the thermal-conductive members 84 and one of the thermal-conductive members 86 that are adjacent to each other in the Z-axis direction will be described.

The thermal-conductive member 84 is an example of a first thermal-conductive member and is formed in a flat plate-like shape whose thickness direction is parallel to the Y-axis direction. When viewed in the Y-axis direction, the thermal-conductive member 84 includes a body portion 84A and an extending portion 84B that extends in the Z-axis direction from an end portion of the body portion 84A in the Z-axis direction. The thermal-conductive member 84 is placed on (is in contact with) the rear surface 55 of the sheet-shaped heater 48. The body portion 84A is formed in a rectangular shape that is long in the Z-axis direction. As an example, the length of the body portion 84A in the X-axis direction is approximately equal to the length of the sheet-shaped heater 48 in the X-axis direction.

The extending portion 84B projects toward the center of the sheet-shaped heater 48 in the Z-axis direction from an end portion of the body portion 84A in the Z-axis direction, the end portion being located on the lower side in the X-axis direction. The extending portion 84B is formed in a rectangular shape that is long in the Z-axis direction. As an example, the length of the extending portion 84B in the X-axis direction is set to be about two-fifth of the length of the body portion 84A in the X-axis direction. As an example, the length of the extending portion 84B in the Z-axis direction is set to be about one-quarter of the length of the body portion 84A in the Z-axis direction.

The thermal-conductive member 86 is an example of a second thermal-conductive member and is formed in a flat plate-like shape whose thickness direction is parallel to the Y-axis direction. When viewed in the Y-axis direction, the thermal-conductive member 86 includes a body portion 86A, an extending portion 86B that extends in the Z-axis direction from an end portion of the body portion 86A, the end portion being located on the near side in the Z-axis direction, and an extending portion 86C that extends in the Z-axis direction from another end portion of the body portion 86A, the other end portion being located on the far side in the Z-axis direction. The thermal-conductive member 86 is placed on (is in contact with) the rear surface 55. The body portion 86A is formed in a rectangular shape that is long in the Z-axis direction. As an example, the length of the body portion 86A in the X-axis direction is approximately equal to the length of the sheet-shaped heater 48 in the X-axis direction (the length of the body portion 84A in the X-axis direction).

The extending portion 86B projects toward the near side in the Z-axis direction from an end portion of the body portion 86A, the end portion being located on the near side in the Z-axis direction and the upper side in the X-axis direction. The body portion 86B is formed in a rectangular shape that is long in the Z-axis direction. As an example, the length of the extending portion 86B in the X-axis direction is set to be about two-fifth of the length of the body portion 86A in the X-axis direction. As an example, the length of the extending portion 86B in the Z-axis direction is set to be about one-quarter of the length of the body portion 86A in the Z-axis direction.

The extending portion 86C projects toward the center of the sheet-shaped heater 48 in the Z-axis direction from an end portion of the body portion 86A, the end portion being located on the far side in the Z-axis direction and the lower side in the X-axis direction. The body portion 86C is formed in a rectangular shape that is long in the Z-axis direction. As an example, the length of the extending portion 86C in the X-axis direction is set to be about two-fifth of the length of the body portion 86A in the X-axis direction. As an example, the length of the extending portion 86C in the Z-axis direction is set to be about one-quarter of the length of the body portion 86A in the Z-axis direction.

The extending portion 84B and the extending portion 86B are arranged so as to overlap each other in the X-axis direction when viewed in the X-axis direction. As an example, these overlapping portions are located further toward the near side in the Z-axis direction than the end of the sheet PA on the near side is and are located further toward the far side in the Z-axis direction than the end of the sheet PB on the near side is. The entirety of thermal-conductive member 84 in the X-axis direction and the entirety of thermal-conductive member 86 in the X-axis direction face each other in the Z-axis direction.

When viewed in the Y-axis direction, each of the spaces 87 has a crank-like shape having portions each extending in the X-axis direction and a portion extending in the Z-axis direction arranged alternately in a continuous manner. A side surface of the thermal-conductive member 84 that defines part of a corresponding one of the spaces 87 and that faces in the X-axis direction will be referred to as a facing surface 88A. A side surface of the thermal-conductive member 86 that defines part of the space 87 and that faces in the X-axis direction will be referred to as a facing surface 88B. In other words, when viewed in the Y-axis direction, the facing surface 88A and the facing surface 88B extend in the Z-axis direction and face each other in the X-axis direction. The facing surface 88A and the facing surface 88B are examples of facing edges that face each other.

A portion of the extending portion 84B that overlaps the extending portion 86B in the X-axis direction has a quadrangular shape. The vertices of this quadrangular shape are denoted by points A, B, C, and D. A portion of the extending portion 86B that overlaps the extending portion 84B in the X-axis direction has a quadrangular shape. The vertices of this quadrangular shape are denoted by points E, F, G, and H. The points B, A, H, and G are positioned on an imaginary line V3 that extends in the X-axis direction. The points C, D, E, and F are positioned on an imaginary line V4 that extends in the X-axis direction.

Here, a portion of the thermal-conductive member 84 and a portion of the thermal-conductive member 86 that are positioned in a region between the imaginary line V3 and the imaginary line V4 in the Z-axis direction (hereinafter referred to as a region N2) are the portions that overlap each other when viewed in the X-axis direction. When viewed in the Y-axis direction, these portions are formed of an end portion S3 that is represented by a quadrangle ABCD and an end portion S4 that is represented by a quadrangle EFGH. The end portion S3 is a portion of the thermal-conductive member 84. The end portion S4 is a portion of the thermal-conductive member 86.

Heat is conducted between the end portion S3 and the other portions of the thermal-conductive member 84, and heat is conducted between the end portion S4 and the other portions of the thermal-conductive member 86. Note that the region N2 is located between the end of the sheet PA on the near side in the Z-axis direction and the end of the sheet PB on the near side in the Z-axis direction.

The portions of the adjacent thermal-conductive members 84 and 86 that face each other have a plurality of corners 92A, 92B, 92C, and 92D. The corners 92A and 92B form corners of the extending portion 84B. The corners 92C and 92D form corners of the extending portion 86B. As an example, all the corners 92A, 92B, 92C, and 92D are set to have an angle of 90 degrees when viewed in the Y-axis direction. Note that the "angle of 90 degrees" is not limited to an exact 90 degrees and also includes angles that differ from 90 degrees within an angle measurement error range.

[Effects]

Effects of the second exemplary embodiment will now be described. Note that descriptions of configurations and effects that are similar to those of the first exemplary embodiment, which have been described above, will be omitted.

According to the fixing device 80, the extending portion 84B and the extending portion 86B are arranged side by side in the X-axis direction, and thus, the space 87 in the X-axis direction is smaller than that in the configuration in which the space 87 extends in the C direction (see FIG. 4A) crossing the X-axis direction.

In addition, according to the fixing device 80, by forming the corners 92A, 92B, 92C, and 92D, the rigidity of each of the thermal-conductive members 84 and 86 against a force acting in the Y-axis direction becomes higher than that in the configuration in which at least one of the corners has an acute angle, and thus, deformation of the thermal-conductive members 84 and 86 in the Y-axis direction is suppressed.

Figure 10:
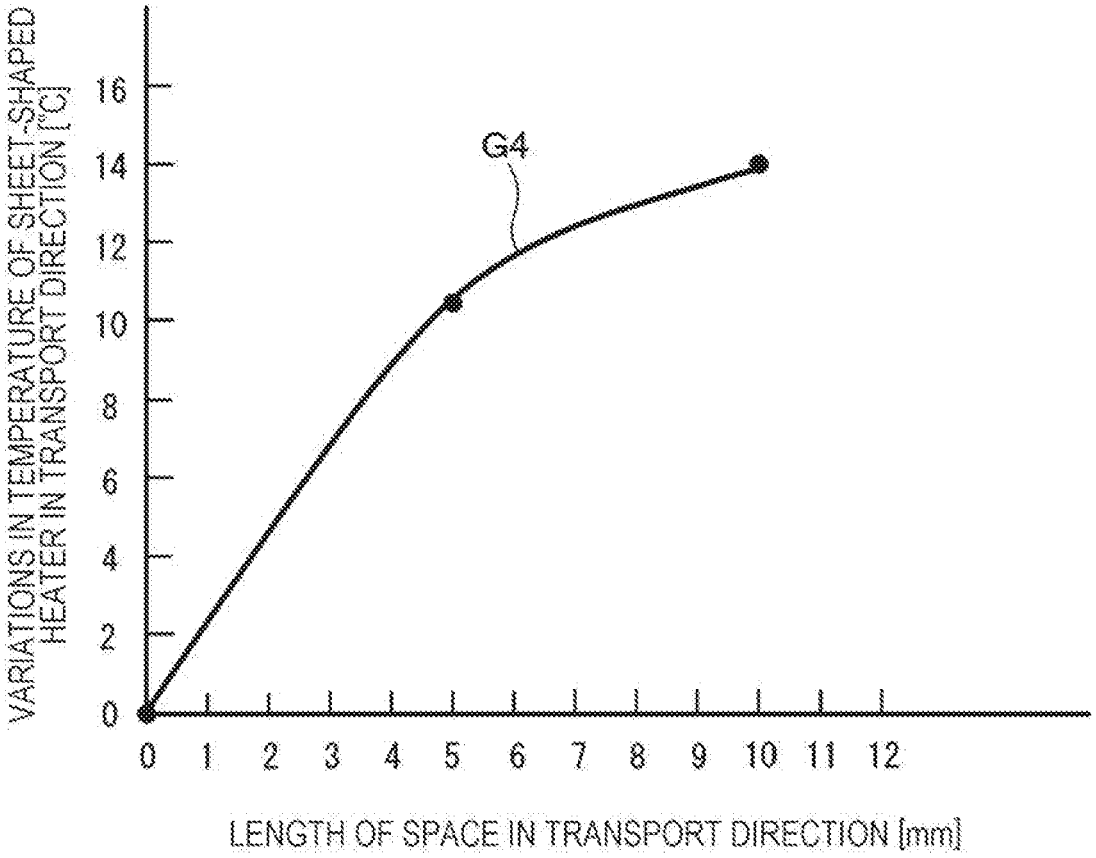
FIG. 10 is a graph illustrating a relationship between the length of a gap formed between the two thermal-conductive members according to the second exemplary embodiment and variations in the temperature of the sheet-shaped heater in the transport direction.

FIG. 10 illustrates a graph G4 illustrating variations in the temperature (° C.) of the sheet-shaped heater 48 (see FIG. 9) in the X-axis direction that occurs when the length (mm) of the space 87 (see FIG. 9) in the X-axis direction in the fixing device 80 (see FIG. 9) is changed. Note that, as an example, the sheet-shaped heater 48 that is made of alumina and that has a thickness of 1 mm is used. As an example, the thermal-conductive members 84 and 86 each of which is formed of a graphite sheet and each of which has a thickness of 50 μm are used. The sheets P on each of which a fixing operation is to be performed are A4 sheets, and a transport speed is set to 35 sheets/minute.

In the graph G4, as the length of the space 87 (gap) in the X-axis direction increases, variations in the temperature becomes larger. Here, it is confirmed that the rate of change of the temperature in a section from 5 mm to 10 mm is smaller than the rate of change of the temperature in a section from 0 mm to 5 mm in length. This is presumably because the thermal-conductive members 84 and 86 contribute more to heat conduction in the Z-axis direction as the length of the space 87 in the X-axis direction increases.

Third Exemplary Embodiment

An image forming apparatus 10 and a fixing device 100 according to a third exemplary embodiment will now be described. Note that members and portions that are basically the same as those of the image forming apparatus 10 and the fixing device 30 according to the first exemplary embodiment, which have been described above, will be denoted by the same reference signs as used in the first exemplary embodiment, and descriptions thereof will be omitted.

Figure 11:
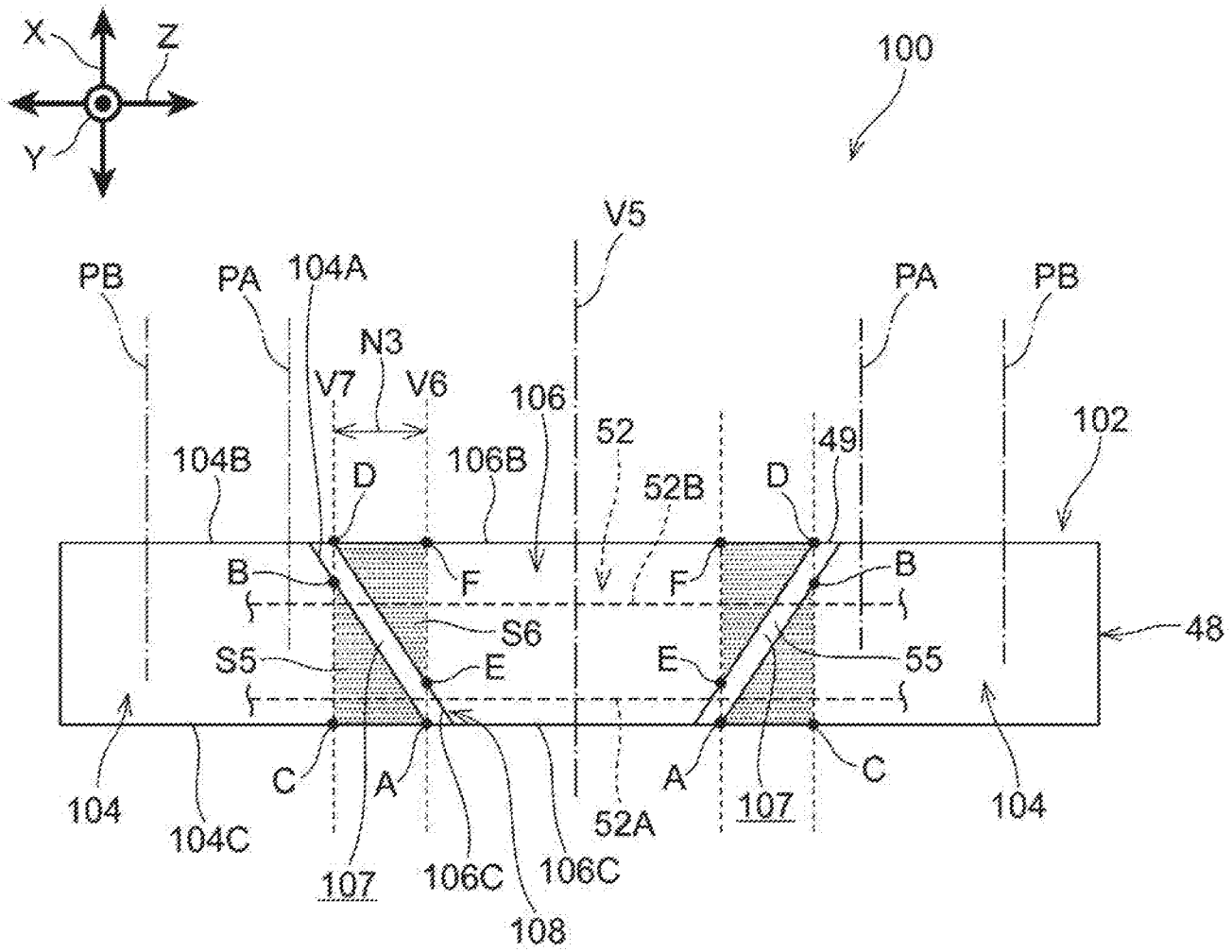
FIG. 11 is a plan view illustrating an arrangement of two thermal-conductive members according to a third exemplary embodiment.

The differences between the fixing device 100 illustrated in FIG. 11 and the fixing device 30 (see FIG. 2) are that the fixing device 100 includes a thermal-conductive member 102 instead of the thermal-conductive members 56 (see FIG. 2) and that the arrangement of the resistive element 52 in the fixing device 100 is different from that of the resistive element 52 in the fixing device 30. The rest of the configuration of the fixing device 100 is similar to that of the fixing device 30.

The thermal-conductive member 102 is a member that is in contact with the rear surface 55 and that conducts heat of the sheet-shaped heater 48 in the Z-axis direction and is made of graphite as an example. The thermal conductivity of the thermal-conductive member 102 in the Z-axis direction is higher than the thermal conductivity of the base member 49 in the Z-axis direction. In other words, in the thermal-conductive member 102, heat is conducted more in the Z-axis direction than in the Y-axis direction.

As an example, the thermal-conductive member 102 includes two thermal-conductive members 104 that are arranged with a gap formed therebetween in the Z-axis direction and one thermal-conductive member 106 that is disposed between the two thermal-conductive members 104 and at the center of the sheet-shaped heater 48 in the Z-axis direction. The thermal-conductive members 104 and the thermal-conductive member 106 are arranged with gaps (spaces 107) formed therebetween in the Z-axis direction and the X-axis direction. The two thermal-conductive members 104 are arranged so as to be substantially line-symmetrical to each other in the Z-axis direction with respect to an imaginary line V5 that passes through the center of the thermal-conductive member 106 and extends in the X-axis direction. Accordingly, one of the thermal-conductive members 104 that is located on the near side in the Z-axis direction and the thermal-conductive member 106 will be described, and the description of the other of the thermal-conductive members 104 that is located on the far side in the Z-axis direction will be omitted.

The thermal-conductive member 104 is an example of the first thermal-conductive member and is formed in a flat plate-like shape whose thickness direction is parallel to the Y-axis direction. When viewed in the Y-axis direction, the external shape of the thermal-conductive member 104 is a trapezoidal shape. More specifically, the thermal-conductive member 104 has a trapezoidal shape whose upper base and lower base extend in the Z-axis direction. One of the legs of the trapezoidal shape of the thermal-conductive member 104, the leg being located on the near side in the Z-axis direction, extends in the X-axis direction, and the other of the legs that is located on the far side is an oblique side crossing the X-axis direction. The thermal-conductive member 104 is placed on the rear surface 55. As an example, the length of the thermal-conductive member 104 in the X-axis direction is equal to the length of the sheet-shaped heater 48 in the X-axis direction.

The thermal-conductive member 106 is an example of the second thermal-conductive member and is formed in a flat plate-like shape whose thickness direction is parallel to the Y-axis direction. When viewed in the Y-axis direction, the external shape of the thermal-conductive member 106 is an isosceles trapezoidal shape as an example. More specifically, an upper surface 106B of the thermal-conductive member 106 that corresponds to the lower base of the trapezoidal shape is positioned on the upper side in the X-axis direction and is a surface extending in the Y-axis direction and the Z-axis direction. A lower surface 106C of the thermal-conductive member 106 that corresponds to the upper base of the trapezoidal shape is positioned on the lower side in the X-axis direction and is a surface extending in the Y-axis direction and the Z-axis direction. Each of the two legs of the thermal-conductive member 106 is an oblique side crossing the X-axis direction. The thermal-conductive member 106 is placed on the rear surface 55. As an example, the length of the thermal-conductive member 106 in the X-axis direction is slightly shorter than the length of the sheet-shaped heater 48 in the X-axis direction.

The thermal-conductive member 104 and the thermal-conductive member 106 are adjacent to each other in the Z-axis direction. An end portion of the thermal-conductive member 104 that is located on the far side in the Z-axis direction and an end portion of the thermal-conductive member 106 that is located on the near side in the Z-axis direction are arranged so as to overlap each other in the X-axis direction when viewed in the X-axis direction. As an example, these overlapping portions (end portions S5 and S6, which will be described later) are located between the two ends of the sheet PA in the Z-axis direction. The entirety of thermal-conductive member 104 in the X-axis direction and the entirety of thermal-conductive member 106 in the X-axis direction face each other in the Z-axis direction.

When viewed in the Y-axis direction, each of the spaces 107 extends linearly in an oblique direction that crosses the X-axis direction. Here, a side surface of the thermal-conductive member 104 that defines part of a corresponding one of the spaces 107 will be referred to as a facing surface 104A. A side surface of the thermal-conductive member 106 that defines part of the space 107 will be referred to as a facing surface 106A. In other words, when viewed in the Y-axis direction, the facing surface 104A and the facing surface 106A extend in an oblique direction and face each other with the space 107 formed therebetween in a direction perpendicular to this oblique direction. The facing surface 104A and the facing surface 106A are examples of facing edges that face each other.

The position of an end of the facing surface 104A, the end being located on the far side in the Z-axis direction when viewed in the Y-axis direction, (an acute-angle vertex of a parallelogram) is denoted by a point A. The point A is positioned on a lower surface 104C of the thermal-conductive member 104 that is located on the lower side in the X-axis direction. A line that passes through the point A and extends in the X-axis direction will be referred to as an imaginary line V6. A surface of the thermal-conductive member 104 that is located on the upper side in the X-axis direction will be referred to as an upper surface 104B. A surface of the thermal-conductive member 106 that is located on the upper side in the X-axis direction will be referred to as the upper surface 106B, and a surface of the thermal-conductive member 106 that is located on the lower side in the X-axis direction will be referred to as the lower surface 106C.

The position of an end of the facing surface 106A, the end being is located on the near side in the Z-axis direction, (an acute-angle vertex of a parallelogram) is denoted by a point D. A point of intersection of the imaginary line V6 and the facing surface 106A is denoted by a point E, and a point of intersection of the imaginary line V6 and the upper surface 106B is denoted by a point F. A line that passes through the point D and extends in the X-axis direction will be referred to as an imaginary line V7. A point of intersection of the imaginary line V7 and the facing surface 104A is denoted by a point B, and a point of intersection of the imaginary line V7 and the lower surface 104C is denoted by a point C.

A portion of the thermal-conductive member 104 and a portion of the thermal-conductive member 106 that are positioned in a region between the imaginary line V6 and the imaginary line V7 in the Z-axis direction (hereinafter referred to as a region N3) are the portions that overlap each other when viewed in the X-axis direction. When viewed in the Y-axis direction, these portions are formed of the end portion S5 that is represented by a triangle ABC and the end portion S6 that is represented by a triangle DEF. Heat is conducted between the end portion S5 and the other portions of the thermal-conductive member 104, and heat is conducted between the end portion S6 and the other portions of the thermal-conductive member 106.

As an example, an obtuse-angle portion that is one of the corners in the thermal-conductive member 106 when viewed in the Y-axis direction excluding the end portion S6 will be referred to as an obtuse-angle portion 108. The obtuse-angle portion 108 is a portion where the lower surface 106C and the facing surface 106A cross each other.

When projected in the Y-axis direction, the heat-generating portion 52A overlaps the obtuse-angle portion 108 (an obtuse-angle side portion). When projected in the Y-axis direction, the heat-generating portion 52B overlaps the end portion S5 and the end portion S6. In other words, as an example, the resistive element 52 is positioned further toward the lower side in the X-axis direction (the upstream side in the transport direction of the sheet PA) than the center of the sheet-shaped heater 48 in the X-axis direction is.

[Effects]

Effects of the third exemplary embodiment will now be described. Note that descriptions of configurations and effects that are similar to those of the first exemplary embodiment, which have been described above, will be omitted.

According to the fixing device 100, since the external shape of the thermal-conductive member 106 when viewed in the Y-axis direction is a trapezoidal shape, unlike a thermal-conductive member whose external shape is a parallelogram shape, the shape of a portion of the thermal-conductive member 106 on the far side in the Z-axis direction and the shape of a portion of the thermal-conductive member 106 on the near side in the Z-axis direction are line-symmetrical to each other with respect to the imaginary line V5. As a result, the thermal-conductive member 102, which includes the thermal-conductive members 104 and the thermal-conductive member 106, may be disposed so as to have a symmetrical structure with respect to the center of the sheet-shaped heater 48 in the Z-axis direction.

In addition, according to the fixing device 100, when projected in the Y-axis direction, the heat-generating portion 52A overlaps the obtuse-angle portion 108. Consequently, the volume of a portion of the thermal-conductive member 106 that is to be heated is larger than that in the configuration in which the heat-generating portion 52A overlaps an acute-angle portion of the thermal-conductive member 106, and thus, the probability that a portion of the thermal-conductive member 106 will be intensively heated is reduced. In other words, deformation of the thermal-conductive member 106 as a result of heat applied to the thermal-conductive member 106 is suppressed compared with the configuration in which the resistive element 52 overlaps an acute-angle portion of the thermal-conductive member 106.

<Modification>

Figure 12:
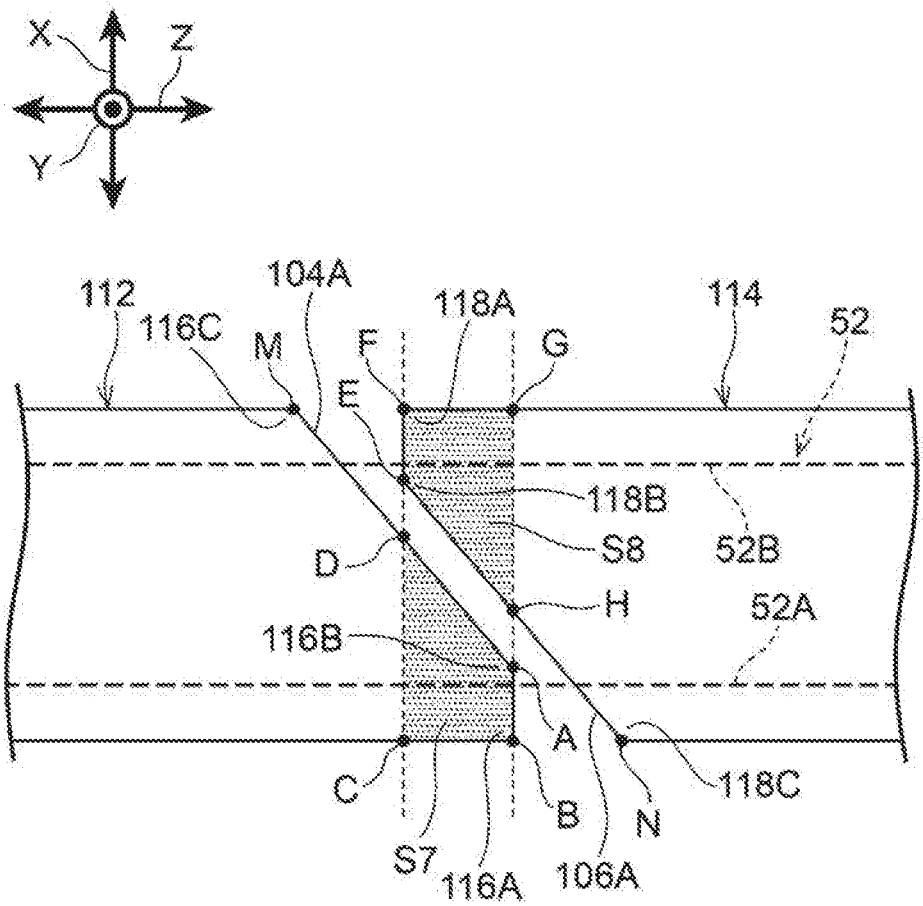
FIG. 12 is a plan view illustrating an arrangement of two thermal-conductive members according to a modification of the third exemplary embodiment.

In FIG. 12, thermal-conductive members 112 and 114 are illustrated as a modification of the third exemplary embodiment.

The thermal-conductive member 112 is an example of the first thermal-conductive member, and the difference between the thermal-conductive member 112 and each of the thermal-conductive members 104 (see FIG. 11) is that an end portion S7 having a trapezoidal shape whose height direction is parallel to the Z-axis direction when viewed in the Y-axis direction is formed by cutting off a tip portion of the end portion S5 (see FIG. 11) in the X-axis direction.

The thermal-conductive member 114 is an example of the second thermal-conductive member, and the difference between the thermal-conductive member 114 and each of the thermal-conductive members 106 (see FIG. 11) is that an end portion S8 having a trapezoidal shape whose height direction is parallel to the Z-axis direction when viewed in the Y-axis direction is formed by cutting off a tip portion of the end portion S6 (see FIG. 11) in the X-axis direction. The end portion S7 and the end portion S8 overlap each other when viewed in the X-axis direction. Note that portions of the thermal-conductive members 112 and 114 that are similar to those of the thermal-conductive members 104 and 106 are denoted by the same reference signs, and descriptions thereof will be omitted.

The four vertices of the end portion S7 are denoted by points A, B, C, and D. A line segment AB corresponds to the upper base of the trapezoidal shape, and a line segment CD corresponds to the lower base of the trapezoidal shape. A line segment AD is positioned on the facing surface 104A. An end point that is opposite to the point A on the facing surface 104A will be referred to as a point M. Similarly, the four vertices of the end portion S8 are denoted by points E, F, G, and H. A line segment EF corresponds to the upper base of the trapezoidal shape, and a line segment GH corresponds to the lower base of the trapezoidal shape. A line segment EH is positioned on the facing surface 106A. An end point that is opposite to the point E on the facing surface 106A will be referred to as a point N.

When viewed in the Y-axis direction, the angle of a corner portion 116A including the point B, the angle of a corner portion 116B including the point A, and the angle of a corner portion 116C including the point M are each an obtuse angle of 90 degrees or greater. Similarly, when viewed in the Y-axis direction, the angle of a corner portion 118A including the point F, the angle of a corner portion 118B including the point E, and the angle of a corner portion 118C including the point M are each an obtuse angle of 90 degrees or greater. As described above, all the corners of the portions of the thermal-conductive members 112 and 114, the portions facing each other in the Z-axis direction, may each be set to have an obtuse angle. As a result, even when the thermal-conductive members 112 and 114 are heated by the resistive element 52, deformation of each of the thermal-conductive members 112 and 114 is suppressed.

Fourth Exemplary Embodiment

An image forming apparatus 10 and a fixing device 120 according to a fourth exemplary embodiment will now be described. Note that members and portions that are basically the same as those of the image forming apparatus 10 and the fixing device 30 according to the first exemplary embodiment, the fixing device 80 according to the second exemplary embodiment, and the fixing device 100 according to the third exemplary embodiment, which have been described above, will be denoted by the same reference signs as used in the first to third exemplary embodiments, and descriptions thereof will be omitted.

Figure 13:
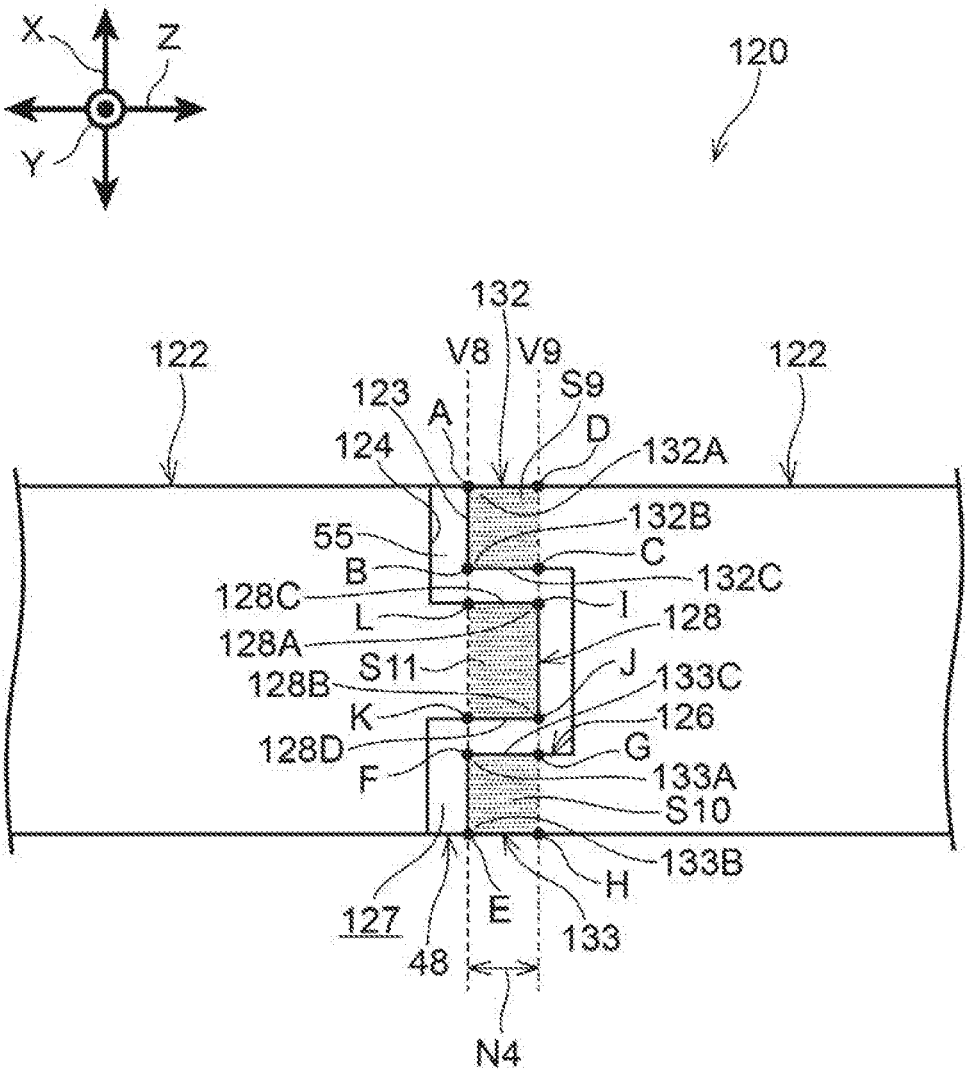
FIG. 13 is a plan view illustrating an arrangement of two thermal-conductive members according to a fourth exemplary embodiment.

The difference between the fixing device 120 illustrated in FIG. 13 and the fixing device 30 (see FIG. 2) is that the fixing device 120 includes a plurality of thermal-conductive members 122 instead of the plurality of thermal-conductive members 56 (see FIG. 2), and the rest of the configuration of the fixing device 120 is similar to that of the fixing device 30. Here, a pair of the thermal-conductive members 122 that are adjacent to each other in the Z-axis direction will be described. The two adjacent thermal-conductive members 122 are arranged with a gap (a space 127) formed therebetween in the Z-axis direction and the X-axis direction.

The thermal-conductive members 122 are members that are in contact with the rear surface 55 and that conduct heat of the sheet-shaped heater 48 in the Z-axis direction and are made of graphite as an example. The thermal conductivity of each of the thermal-conductive members 122 in the Z-axis direction is higher than the thermal conductivity of the base member 49 (see FIG. 5) in the Z-axis direction. In other words, in the thermal-conductive members 122, heat is conducted more in the Z-axis direction than in the Y-axis direction.

Each of the thermal-conductive members 122 is formed in a flat plate-like shape whose thickness is parallel to the Y-axis direction. In addition, when viewed in the Y-axis direction, the external shape of a large portion of each of the thermal-conductive members 122 is a rectangular shape that is long in the Z-axis direction. An end portion of one of the thermal-conductive members 122, the end portion being located on the near side in the Z-axis direction, has a first end surface 123 a portion of which extends in the X-axis direction. A recess 126 that is recessed in the Z-axis direction when viewed in the Y-axis direction is formed at a center portion of the end surface 123 in the X-axis direction. An end portion of the other of the thermal-conductive members 122, the end portion being located on the far side in the Z-axis direction, has a second end surface 124 a portion of which extends in the X-axis direction. A projection 128 that projects in the Z-axis direction when viewed in the Y-axis direction is formed at a center portion of the end surface 124 in the X-axis direction.

The recess 126 is recessed toward the far side in the Z-axis direction from the end surface 123. The shape of the recess 126 is a quadrangular shape extending in the X-axis direction and the Z-axis direction. In other words, the end portion of the one of the thermal-conductive members 122 on the near side in the Z-axis direction is formed in a U-shape that is open toward the near side in the Z-axis direction. Note that, in the one of the thermal-conductive members 122, a portion that is located on the upper side in the X-axis direction with respect to the recess 126 will be referred to as an extending portion 132, and a portion that is located on the lower side in the X-axis direction with respect to the recess 126 will be referred to as an extending portion 133.

Corners 132A and 132B are formed at an end of the extending portion 132 in the Z-axis direction. When viewed in the Y-axis direction, the angle of each of the corners 132A and 132B is 90 degrees as an example. The extending portion 132 has an end portion S9 that is represented by a quadrangular shape ABCD.

Corners 133A and 133B are formed at an end of the extending portion 133 in the Z-axis direction. When viewed in the Y-axis direction, the angle of each of the corners 133A and 133B is 90 degrees as an example. The extending portion 133 has an end portion S10 that is represented by a quadrangular shape EFGH.

The projection 128 projects toward the far side in the Z-axis direction from the end surface 124. The shape of the projection 128 is a quadrangular shape extending in the X-axis direction and the Z-axis direction. In addition, the projection 128 is inserted in the recess 126. The length of the projection 128 in the X-axis direction is shorter than the length of the recess 126 in the X-axis direction. As an example, the length of the projection 128 in the Z-axis direction is set to be approximately equal to the length of the extending portion 132 or the extending portion 133 in the Z-axis direction. Corners 128A and 128B are formed at an end of the projection 128. When viewed in the Y-axis direction, the angle of each of the corners 128A and 128B is 90 degrees as an example. In addition, the projection 128 has an end portion S11 that is represented by a quadrangular shape IJKL.

A line that passes through points A, B, L, K, F, and E and extends in the X-axis direction will hereinafter be referred to as an imaginary line V8. A line that passes through points D, C, I, J, G, and H and extends in the X-axis direction will hereinafter be referred to as an imaginary line V9. Portions of the adjacent thermal-conductive members 122 that are positioned in a region between the imaginary line V8 and the imaginary line V9 in the Z-axis direction (hereinafter referred to as a region N4) are portions that overlap each other when viewed in the X-axis direction. In other words, the end portions S9, S10, and S11 are located in the region N4.

When viewed in the Y-axis direction, the space 127 is formed in a crank-like shape that is bent at substantially right angles at four positions. The length of the space 127 in the Z-axis direction and the length of the space 127 in the X-axis direction are set to be approximately equal to each other. Here, a surface of the extending portion 132 that faces the projection 128 in the X-axis direction will hereinafter be referred to as a facing surface 132C. A surface of the projection 128 that faces the extending portion 132 in the X-axis direction will hereinafter be referred to as a facing surface 128C. A surface of the projection 128 that faces the extending portion 133 in the X-axis direction will hereinafter be referred to as a facing surface 128D. A surface of the extending portion 133 that faces the projection 128 in the X-axis direction will hereinafter be referred to as a facing surface 133C. The facing surfaces 132C, 128C, 128D, and 133C are examples of facing edges that face one another and are surfaces that extend in the Z-axis direction when viewed in the Y-axis direction.

[Effects]

Effects of the fourth exemplary embodiment will now be described. Note that descriptions of configurations and effects that are similar to those of the first and second exemplary embodiments, which have been described above, will be omitted.

When an operation of joining the plurality of thermal-conductive members 122 to the sheet-shaped heater 48 is performed (at the time of manufacture), the projection 128 is inserted into the recess 126, so that the end portion S9 is positioned on the upper side (first side) in the X-axis direction with respect to the end portion S11, and the end portion S10 is positioned on the lower side (second side) in the X-axis direction with respect to the end portion S11. Here, in the case where one of the thermal-conductive members 122 is displaced in the X-axis direction, the projection 128 and the extending portion 132 are brought into contact with each other, or the projection 128 and the extending portion 133 are brought into contact with each other. As a result, large displacement of the thermal-conductive members 122 in the X-axis direction in the manufacture of the fixing device 120 is suppressed compared with the configuration in which the projection 128 is not inserted in the recess 126.

Note that the present disclosure is not limited to the above-described exemplary embodiments.

In the fixing device 30, the plurality of thermal-conductive members 56 may have different length in the X-axis direction. In addition, it is only necessary for the plurality of thermal-conductive members 56 to at least partially overlap each other when viewed in the Z-axis direction. A portion of each of the facing surfaces 58A and 58B may extend in the X-axis direction.

In the fixing device 80, the facing surfaces 88A and 88B may face each other in a direction crossing the X-axis direction. Each of the thermal-conductive members 82 may have an acute-angle portion.

In the fixing device 100, the thermal-conductive members 104 and 106 may have different lengths in the X-axis direction. In addition, it is only necessary for the thermal-conductive members 104 and 106 to at least partially overlap each other when viewed in the Z-axis direction. Furthermore, the number of thermal-conductive members that are included in the thermal-conductive member 102 is not limited to three and may be any odd number that is three or greater. A portion of each of the facing surfaces 104A and 106A may extend in the X-axis direction. The resistive element 52 may not be positioned at the obtuse-angle portion 108.

In the fixing device 120, the facing surfaces 128C, 128D, 132C, and 133C may face one another in a direction crossing the X-axis direction. Each of the thermal-conductive members 122 may have an acute-angle portion.

The rotating body is not limited to the belt 46 and may be a cylindrical member made of a resin.

Each of the thermal-conductive members 56, 82, 102, and 122 is not limited to being a member that has a flat plate-like shape extending along the X-Z plane and may be, for example, a member that is curved so as to project toward the upper side or the lower side in the X-axis direction when viewed in the Z-axis direction. In the case where each of the plurality of thermal-conductive members is a curved member, it is only necessary for the plurality of thermal-conductive members to be arranged so as to partially overlap one another in the X-axis direction when viewed in the X-axis direction while being arranged in the X-Z plane (a plane). The thermal-conductive members 56, 82, 102, and 122 may be made of different materials such that two of the thermal-conductive members that are positioned at the opposite ends in the Z-axis direction each have a thermal conductivity higher than that of each of the other thermal-conductive members that are positioned between the two thermal-conductive members in the Z-axis direction.

The thermal-conductive members 56, 82, 102, and 122 may have different thicknesses in the X-axis direction. For example, the thicknesses of the thermal-conductive members 56, 82, 102, and 122 in the X-axis direction may be changed by attaching a sheet-shaped thermal-conductive member to portions of the thermal-conductive members 56, 82, 102, and 122 in the Y-axis direction.

Since it is only necessary for the plurality of thermal-conductive members to be arranged so as to partially overlap each other in the X-axis direction, the plurality of thermal-conductive members may be arranged in such a manner as to be spaced apart from one another in the X-axis direction. Although not illustrated, for example, assume that there are rectangular thermal-conductive members A and B that are adjacent to each other in the Z-axis direction and rectangular thermal-conductive members C and D that are adjacent to each other in the Z-axis direction. In addition, assume that a space d1 extending in the X-axis direction is formed between the thermal-conductive member A and the thermal-conductive member B, and a space d2 extending in the X-axis direction is formed between the thermal-conductive member C and the thermal-conductive member D. Here, if the thermal-conductive members A, B, C, and D are arranged such that the space d1 and the space d2 are not aligned in the X-axis direction, at any position in the Z-axis direction, heat conduction may be performed at a position in the X-axis direction.

In the fixing devices 30, 80, 100, and 120, each of the sheet-shaped heaters and each of the thermal-conductive members may not be disposed at a position that corresponds to the nip part NP. For example, a fixing device may be employed that has a configuration in which the sheet-shaped heaters and the thermal-conductive members are positioned further upstream than the nip part NP is in the direction of rotation of the belt 46 and are located inside the belt 46. In this fixing device, the belt 46 is heated at a position further upstream than the nip part NP is, and the toner image G is heated and pressurized by the belt 46 at the nip part NP.

In the image forming apparatus 10, a developer image obtained by using an image forming unit that employs an ink-jet system (a liquid droplet discharging method) instead of using the image forming unit 16 may be fixed in place by each of the fixing devices 30, 80, 100, and 120.

The present disclosure is not limited to the above-described exemplary embodiment, and various modifications and applications may be made within the gist of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a hollow rotating body;

a sheet-shaped heater that is disposed inside the rotating body in such a manner as to extend in a width direction perpendicular to a transport direction of a recording medium, which is transported along with rotation of the rotating body, and that heats the rotating body; and a plurality of thermal-conductive members that are arranged in such a manner as to be in contact with a surface of the sheet-shaped heater, the surface being opposite to a contact surface of the sheet-shaped heater that is in contact with the rotating body, with a gap formed between the plurality of thermal-conductive members in at least one of the width direction and the transport direction and that conduct heat of the sheet-shaped heater in the width direction, the plurality of thermal-conductive members being arranged such that a first thermal-conductive member and a second thermal-conductive member that are included in the plurality of thermal-conductive members and that are adjacent to each other partially overlap each other when the thermal-conductive members in a state of being arranged in a plane are viewed in the transport direction.

2. The fixing device according to claim 1, wherein the adjacent thermal-conductive members have the same length in the transport direction and entirely overlap each other when viewed in the width direction.

3. The fixing device according to claim 2, wherein portions of the adjacent thermal-conductive members that face each other have a plurality of corners, and wherein each of the plurality of corners has an angle of 90 degrees or greater when viewed in a thickness direction that is perpendicular to the transport direction and to the width direction.

4. The fixing device according to claim 2, wherein facing edges of the adjacent thermal-conductive members that face each other extend in a crossing direction that crosses the transport direction when viewed in a thickness direction that is perpendicular to the transport direction and to the width direction.

5. The fixing device according to claim 4, wherein the number of the plurality of thermal-conductive members is an odd number that is three or greater, and wherein an external shape of one of the plurality of thermal-conductive members, the one thermal-conductive member being positioned at the center in the width direction, is an isosceles trapezoidal shape when viewed in the thickness direction.

6. The fixing device according to claim 5, wherein portions of the adjacent thermal-conductive members that face each other have a plurality of corners, and wherein each of the plurality of corners has an angle of 90 degrees or greater when viewed in the thickness direction perpendicular to the transport direction and to the width direction.

7. The fixing device according to claim 4, wherein portions of the adjacent thermal-conductive members that face each other have a plurality of corners, and wherein each of the plurality of corners has an angle of 90 degrees or greater when viewed in the thickness direction perpendicular to the transport direction and to the width direction.

8. The fixing device according to claim 1, wherein facing edges of the adjacent thermal-conductive members that face each other extend in a crossing direction that crosses the transport direction when viewed in a thickness direction that is perpendicular to the transport direction and to the width direction.

9. The fixing device according to claim 8, wherein the number of the plurality of thermal-conductive members is an odd number that is three or greater, and wherein an external shape of one of the plurality of thermal-conductive members, the one thermal-conductive member being positioned at the center in the width direction, is an isosceles trapezoidal shape when viewed in the thickness direction.

10. The fixing device according to claim 9, wherein portions of the adjacent thermal-conductive members that face each other have a plurality of corners, and wherein each of the plurality of corners has an angle of 90 degrees or greater when viewed in the thickness direction perpendicular to the transport direction and to the width direction.

11. The fixing device according to claim 8, wherein portions of the adjacent thermal-conductive members that face each other have a plurality of corners, and wherein each of the plurality of corners has an angle of 90 degrees or greater when viewed in the thickness direction perpendicular to the transport direction and to the width direction.

12. The fixing device according to claim 1, wherein facing edges of the adjacent thermal-conductive members that face each other have at least portions that face each other in the transport direction when viewed in a thickness direction that is perpendicular to the transport direction and to the width direction.

13. The fixing device according to claim 12, wherein one of the adjacent thermal-conductive members has an end surface in the width direction, the end surface having a recess that is recessed in the width direction when viewed in the thickness direction, wherein another one of the adjacent thermal-conductive members has an end surface in the width direction, the end surface having a projection that projects in the width direction when viewed in the thickness direction, and wherein the projection is inserted in the recess.

14. The fixing device according to claim 13, wherein portions of the adjacent thermal-conductive members that face each other have a plurality of corners, and wherein each of the plurality of corners has an angle of 90 degrees or greater when viewed in the thickness direction perpendicular to the transport direction and to the width direction.

15. The fixing device according to claim 12, wherein portions of the adjacent thermal-conductive members that face each other have a plurality of corners, and wherein each of the plurality of corners has an angle of 90 degrees or greater when viewed in the thickness direction perpendicular to the transport direction and to the width direction.

16. The fixing device according to claim 1, wherein portions of the adjacent thermal-conductive members that face each other have a plurality of corners, and wherein each of the plurality of corners has an angle of 90 degrees or greater when viewed in a thickness direction that is perpendicular to the transport direction and to the width direction.

17. An image forming apparatus comprising:

an image forming unit that forms a developer image onto the recording medium; and the fixing device according to claim 1 that fixes the developer image onto the recording medium by applying heat and pressure to the developer image.

* * * * *